US008572876B2

(12) United States Patent
Shekarri et al.

(10) Patent No.: US 8,572,876 B2
(45) Date of Patent: Nov. 5, 2013

(54) SYSTEMS AND METHODS FOR DETECTING USE OF AN ELECTRONIC CONTROL DEVICE

(75) Inventors: Nache D. Shekarri, Phoenix, AZ (US); John F. Szakach, Scottsdale, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

(21) Appl. No.: 12/981,349

(22) Filed: Dec. 29, 2010

(65) Prior Publication Data

US 2011/0156914 A1 Jun. 30, 2011

Related U.S. Application Data

(63) Continuation of application No. 12/114,656, filed on May 2, 2008, now Pat. No. 8,166,693.

(51) Int. Cl.
*A22B 3/06* (2006.01)

(52) U.S. Cl.
USPC ..... 42/1.08

(58) Field of Classification Search
USPC ..... 42/1.08; 607/28, 48
See application file for complete search history.

(56) References Cited

U.S. PATENT DOCUMENTS

| | | | | |
|---|---|---|---|---|
| 2,929,991 | A * | 3/1960 | Skelton | 324/161 |
| 3,450,990 | A * | 6/1969 | Green et al. | 324/76.39 |
| 5,465,687 | A | 11/1995 | Custer | |
| 6,166,643 | A | 12/2000 | Janning | |
| 6,412,207 | B1 | 7/2002 | Crye | |
| 6,897,783 | B2 | 5/2005 | Zeng | |
| 6,933,851 | B2 | 8/2005 | Hahne | |
| 7,000,439 | B2 | 2/2006 | DiDomenico | |
| 7,161,578 | B1 | 1/2007 | Schneider | |
| 7,168,357 | B2 | 1/2007 | Hodgkinson | |
| 2002/0123770 | A1 * | 9/2002 | Combs et al. | 607/9 |
| 2007/0183115 | A1 | 8/2007 | Myers | |
| 2009/0018610 | A1 * | 1/2009 | Gharib et al. | 607/48 |
| 2011/0031928 | A1 | 2/2011 | Soar | |
| 2011/0060243 | A1 * | 3/2011 | Hausman et al. | 600/554 |
| 2011/0238141 | A1 * | 9/2011 | Webb et al. | 607/89 |

* cited by examiner

*Primary Examiner* — Stephen M Johnson
(74) *Attorney, Agent, or Firm* — William R. Bachand; Lawrence Letham

(57) ABSTRACT

A system detects that an electronic control device for inhibiting use of skeletal muscles by a human or animal target has been used. The system includes a radio receiver and a circuit. The electronic control device causes a radio signal when used. The circuit detects a plurality of properties of a received radio signal and outputs a signal in response to comparing the received properties to expected properties.

19 Claims, 12 Drawing Sheets

SYSTEMS AND METHODS FOR DETECTING USE OF AN ELECTRONIC CONTROL DEVICE

CROSS-REFERENCE TO RELATED APPLICATIONS

This application is a continuation application of and claims priority under 35 U.S.C. §120 from U.S. patent application Ser. No. 12/114,656, now U.S. Pat. No. 8,166,693, filed May 2, 2008 by Paul J. Hughes, et al.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
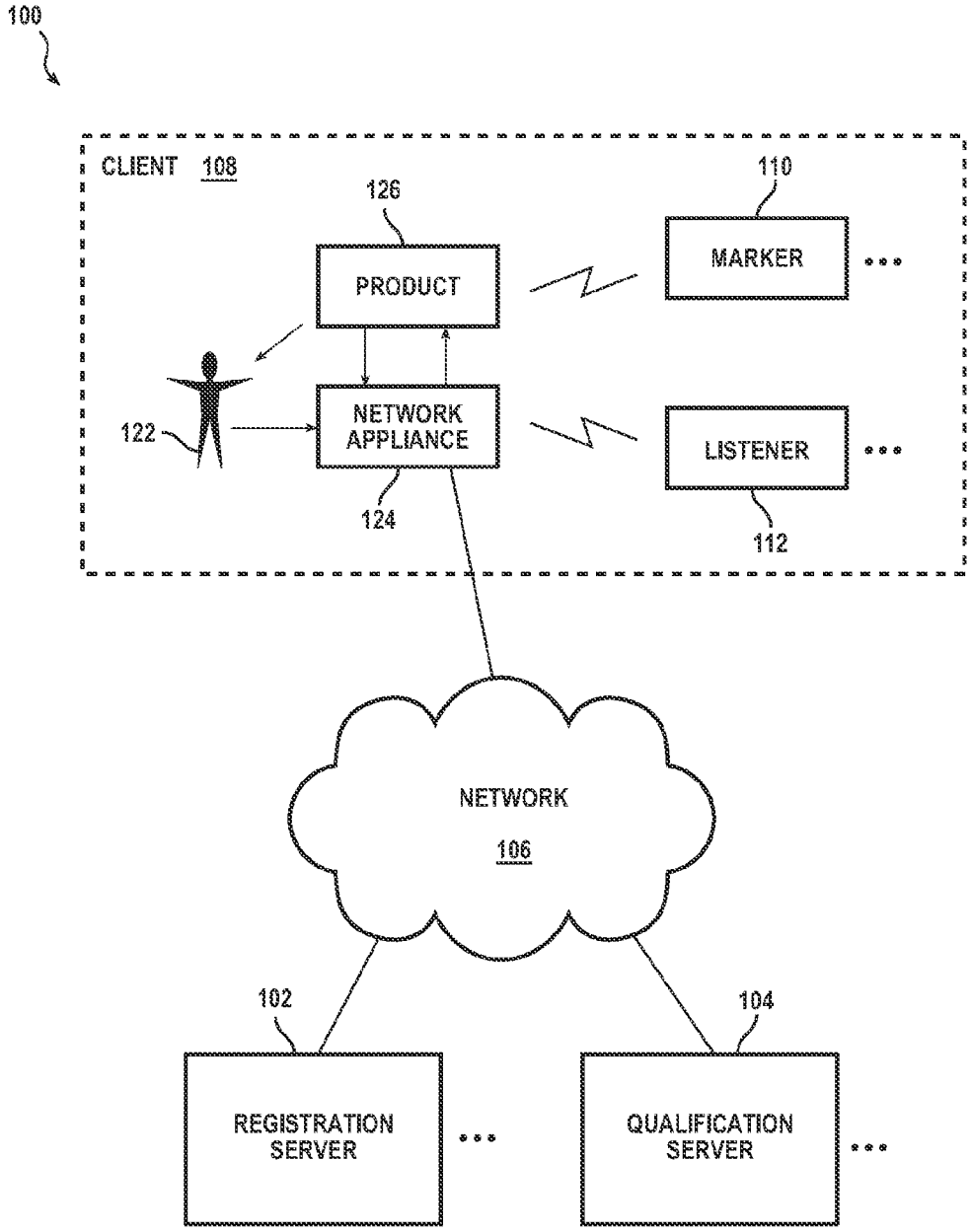
FIG. 1 is a functional block diagram of a network environment for registering a qualified applicant to use a product according to various aspects of the present invention.

According to various aspects of the present invention, a function of a product is to be allowed to be used only after a person successfully completes a method for qualified registration. In an application of systems and methods of the present invention, the person typically has possession of the product. Possession may be a result of purchasing the product from a seller, receiving the product from a donor as a gift, or being allowed use of the product owned by another. Registration may result in one, some, or all functions of the product becoming enabled for use. Typically, an applicant completes a method for qualified registration by providing information that meets qualification criteria to permit the applicant to use the product. Systems and methods of the present invention are intended to make it difficult for qualified registration to be completed by someone other than the user of the product. For example, the applicant for qualified registration must have possession of the product and must be able to supply information that is unlikely anyone other than the applicant would be able to supply. If registration by an agent of the user is not desired, systems and methods of the present invention may require provision of information extremely unlikely to be known by anyone other than the user and/or may require biometric information unique to the user.

In an important class of implementations according to various aspects of the present invention, use is permitted for an indefinite period of time following registration. In another important class of implementations according to various aspects of the present invention, use is permitted for a period that expires on a predetermined event or on the first to occur of a set of predefined events. An event is detected by the product to disable one, some, or all functions of the product. An event may include lapse of a predetermined amount of time, the current date and/or time reaching a terminating date and/or time, a quantity of uses of the product, misuse of the product, removal of the product from a permitted zone, attempting to operate the product when the product is not in a permitted zone, or a reset of the product via a user interface of the product or via a covert interface of the product.

Qualified registration produces an association of a description of a user and a description of the product when one or both of the descriptions are consistent with qualification criteria. Qualified registration also produces a message or signal conveying information that enables one, some, or all functions of the product (herein called permitted functions). Qualified registration may be completed in a network environment. In an important class of implementations according to various aspects of the present invention, a method for qualified registration includes determining whether sources of information conveyed on the network are trustworthy. Sources of information conveyed by the network include a registration server, the applicant, and the product. The applicant and the product provide information via one or more network appliances that are coupled to the network. The product may include a network appliance for information provided by the product and/or for information provided by the applicant.

Systems and methods according to the present invention address one or more of the following trust issues: (a) whether the applicant is a person; (b) whether the information provided by the applicant uniquely identifies the person intending to be the user of the product; (c) whether the person intending to be the user of the product is intending to be an exclusive user of the product; (d) whether the person intending to be the user of the product is likely to be an exclusive user of the product; (e) whether information purportedly supplied by the product is likely to have been supplied by a product (as opposed to a subversive apparatus); (f) whether information purportedly supplied by the product is likely to have been supplied by the product that is in the possession of the applicant; and (g) whether information purportedly supplied by a registration server is likely to have been supplied by a registration server (as opposed to a subversive apparatus). Systems and methods according to various aspects of the present invention address these issues to decrease to an acceptable minimum the risk that a product will be enabled for use by a person who does not actually meet the qualification criteria. Practice of the present invention limits the quantity of products able to be used by unqualified persons.

Qualified registration, according to various aspects of the present invention, may be accomplished with the exchange of a series of messages between the applicant, the product, a registration server, and a qualification server. A network environment for communication relieves the requirement that these entities be physically hardwired together or within range of communication. A network may be omitted when communication via wired connections or physical location in range for communication is feasible. Use of two types of servers, specifically a registration server and a qualification server, permits different economic entities to manage each type of server. The registration server and qualification server functions may be hosted by a single server if desired.

Qualified registration for a product may be accomplished with a division of functions in a network environment of the type described with reference to FIGS. 1, 2A through 2D, and 3A. Expiration of registration for the product may be accomplished with a division of functions described with reference to FIGS. 1 and 3A through 3C. A product capable of registration and expiration of registration may be of the type described with reference to FIGS. 1 through 9.

Network environment 100 of FIG. 1 includes one or more registration servers of which registration server 102 is typical, one or more qualification servers of which qualification server 104 is typical, a network 106 that provides communication between servers and network appliances, and, for each session of qualified registration, a client of which client 108 is typical. Client 108 includes an applicant for registration 122, a network appliance 124 coupled to network 106, a product 126 that is able to communicate with network appliance 124, any number of markers 110, and any number of listeners 112. Each particular client (e.g., 108) presents a unique instance of subject matter (a particular tuple) for registration involving at least the identity of a person of applicant (e.g., 122) and the identity of a product (e.g., 126). Client/server network environment 100 supports an indefinite number of simultaneous instances of subject matter for registration.

Messages are conveyed among entities (e.g., servers and network appliances) by the network in a manner that permits an entity to direct a message to another entity using a unique address of the entity; and to receive messages that were addressed to itself by another entity. Unfortunately, subversive activity may also be supported by the network including an entity intentionally receiving messages not addressed to that entity and an entity sending messages using an address that belongs to another entity. Systems and methods according to various aspects of the present invention greatly reduce the possibility that such subversive activities result in unauthorized registration of product functions.

A network includes any communication topology that supports communication of a type described with reference to FIGS. 2A through 2D. One or more networks and/or links may be used. Communication may include messages and/or signals in any conventional technology, format, and modulation. For example, network 106 includes conventional hardware and software for a global digital communication network for controls, data, voice, and/or images (e.g., a TCP/IP network, a GSM network, a CDMA network, a Bluetooth network extension, a proprietary protocol network). Network 106 may include a combination of network topologies and protocols with suitable conventional links and bridges.

A server includes any computer system having conventional hardware and software for performing conventional network communication processes. Server processes include communication, database management, and synchronized keeping of date and time information. A server is a type of computer designed with an emphasis on high volume communication and, in some cases, high volume transactions involving data storage. A registration server 102 is a server that also performs a registrar process. A qualification server 104 is a server that also performs a qualifier process. Network server, registrar, and qualifier processes typically: (a) determine the information and format the messages conveying such information to be provided via the network, (b) receive messages from the network and determine received information from such messages, and (c) respond to received information. Responding may include determining information to be provided in accordance with and/or in response to information received. Depending on the network protocol(s) selected for particular information, messages, and signals, servers may include suitable hardware and software for control and data processing (e.g., database management, back office subsystems), voice processing (e.g., voice automated subsystems, automated telephone subsystems), and/or image processing (e.g., determining information from an image such as identifying persons, products, and text).

A registration server 102 and a qualification server 104 may communicate via a link (not shown) for secure communication or cost accounting. Such a link may be separate from and/or different from network 106. Either network 106 or a link not part of network 106 may be used as a primary or secondary channel for communication between a registration server and a qualification server. Information to be communicated may be communicated via either or both the network and the link for trust, security, redundancy, or efficiency.

A network appliance includes any electronic device having a network communication capability and a user interface. A network appliance is a type of computer with a design emphasis on supporting both a sophisticated or special purpose network interface and a sophisticated or special purpose user interface. Conventional network appliances include, for example, computer work stations, personal digital assistants, and cellular phones. Conventional user interfaces include: a graphical user interface, a menu driven user interface, a keypad user interface (e.g., QWERTY, 12-key phone pad), a user interface comprising special purpose controls and indicators (or a display). According to various teachings of the present invention, an aspect of the user interface of a network appliance may be used to communicate messages and/or signals to a product. A conventional computer workstation monitor or the speaker may be used. A conventional display or speaker of a personal digital assistant or cell phone may be used. For example, a physical region of the display or a frequency band of a speaker may be used for communicating with a type of product having a receiver for light and/or sound. Use of a portion of the user interface for communicating with a product may be accomplished with additional software accepted and performed by the browser. A network appliance may also have other interfaces through which communication to a product may be accomplished. For example, any conventional cable interface may be used (e.g., a printer interface, USB interface). A wireless interface may also be used (e.g., a Bluetooth interface). For simplicity of product hardware, a self clocking serial interface is preferred.

In one implementation, network appliance 124 may include a processor, a text and graphics display, a speaker, a QWERTY keyboard, and a mouse. Network appliance 124 may further include a conventional browser for network communication and software performing a graphical user interface. Network appliance 126 in this implementation may further include a browser having a Java Virtual Machine that accepts applets for processes that support communication to product 126 (e.g., 210, 214). Communication between the browser and the network may include protocols for information exchange such as HTTP, HTML, XML, and forms interfaces (e.g. WinForms marketed by Microsoft Corp.)

A registration server and product may communicate in part via a link (not shown) not supported through a network appliance. Such a link may be separate from and/or different from the channel that includes network 106 through the network appliance. Either the channel through the network appliance or the link may be used as a primary or secondary channel for communication. Portions of the information to be communicated may be communicated via either or both the channel through the network appliance and the link for trust, security, redundancy, or efficiency.

An applicant is capable of receiving information from a user interface of the product and providing information to a network appliance. According to various aspects of the present invention, the interfaces and the information suitably make it difficult to replace a person with a process in place of the applicant.

An interface between the network appliance and the applicant may include a conventional controls and displays including a graphical user interface with pointing device, a menu driven interface with navigation button(s), a command line interface with a QWERTY keyboard, or a special purpose manual switch and indicator interface.

A product includes any process (e.g., application software) or device capable of communicating with a network appliance and an applicant. A process type product may be hosted on a network appliance (e.g., the same or different from network appliance 124). The product may include processing software or logic circuitry for establishing trust between the product and a registration server. The product may include memory that stores a logical state of the product, software, and/or information received from a network appliance. A state may be implemented in any conventional circuitry having memory or in any memory or data storage device (e.g., register, counter, software variable, pointer, base address, mode, record of a data base or list, environment, context).

An interface between the product and the applicant may inform the applicant via visual and/or audio techniques for the applicant to see and/or hear. A conventional display may be used (e.g., light emitter, light reflector, light refractor) for alphanumeric, numeric, or binary indications. Binary user interfaces may include blinks of light or audio beeps (e.g. presence/absence of particular pitches, harmony, quantity of beeps, durations of beeps, Morse code). A conventional sound emitter may be used (e.g., speaker, transducer) for audible information (e.g., voice, tones, DTMF, telephone modem signals).

An interface between the product and a network appliance (or registration server) may include any conventional messaging and/or signaling capabilities. For a product comprising an enclosed device, such an interface may be wireless to preserve an hermetic seal of the enclosure. For example, a serial interface using a self clocking modulation (e.g., a Manchester code) may be used to allow for variation in the processing capability and protocol(s) of the network, network appliance (or registration server). The serial interface may be single ended or differential (for common mode signal rejection).

One or more optical channels may be used at the interface between the product and a network appliance. For example, a product comprising an enclosure may include a transparent or translucent portion of the enclosure for light from a display to be detected inside the enclosure. Such a product may be held close to a display of the network appliance. All or part of the display may show an outline of the product for proper orientation of the product against the display. All or part of the display may be modulated in color and/or intensity (e.g., black/white shift keyed) to communicate from the network appliance through the enclosure to a detector of the product.

One or more magnetic channels and/or electrostatic channels may be used at the interface between the product and a network appliance in a manner analogous to the optical channels discussed above. A product shaped as removable magnetic media may be inserted into a drive for such media. Communication may be optical, magnetic, or electrostatic.

An audio channel may be used (e.g., microphone, transducer) at the interface between the product and a network appliance. The product may be held close to the speaker of a network appliance (e.g., a telephone, personal computer, personal digital assistant).

A radio channel (e.g., a CDMA, GSM, Bluetooth, IEEE 802) may be used at the interface between the product and a network appliance. Communication over the radio channel may be controls, data, voice coded as data, and/or images coded as data. For example, when the interface into the product includes a cellular phone link, any conventional control (e.g., the caller ID) may convey information.

Use of any function of a product may be further conditioned on whether the product is in a zone. If the product is not in a zone, use of a permitted function of the product may be disabled. To regain use of the function, a prerequisite condition must be accomplished successfully. For example, the prerequisite condition may include any one or more of the following: re-establishing the product in the zone, repeating some or all of a method for qualified registration, entering a code at a user interface of the product, performing a soft or hard reset of the product using an overt or covert user interface of the product. Registration may be conditioned upon the product being in a zone during performance of all or part of the method of registration. Repeat registration may be conditioned upon the product being in a zone during performance of the prerequisite condition.

A zone is defined by one or more markers and/or by information stored in the product. A zone may include a physical distance, such as a range of communication by any signaling technology. For example, a product may be in a zone when the product is proximate to a marker within the physical distance. In one implementation, the marker defines the zone by the physical location of the marker. The zone may include an area or volume (herein called a region) within which communication is within range. In one implementation, the marker defines the zone by its central location within the region. Markers may be unique or duplicated. For example, numerous identical markers may be used to include in a zone overlapping or distinct regions of the same type.

A peripheral boundary of a region may be defined by a plurality of markers. The product may determine that it is within the zone by communicating with several markers. The determination may include conventional ranging and/or triangulation technologies.

A marker may define a zone by communicating information to the product. For example, a system of markers may inform the product of the physical location of the product (e.g., a global positioning system (GPS)). If the product has stored within it a description of a zone (e.g., central point and distance therefrom, a set of peripheral boundaries), the product may determine from the marker and the description whether or not the product is in the zone. Communication with a marker may be implemented with a receiver in the product or a transceiver in the product.

The product may receive communication from a marker continuously, at expected times, periodically, or with reference to a transmission by the product (e.g., a broadcast or addressed message). The product may use no address, a group address, and/or a unique address for communication with one or more markers. Each marker may use no address, a group address, and/or a unique address for communication with one or more products.

A failure of communication with one or more markers may indicate that the product is not physically present in the zone, that a marker has failed, and/or that communication has been disrupted. A product may conclude that it is not in a zone as a result of any one or more of these conditions. These conditions may be recognized immediately and/or if they persist for a suitable period of time.

A product may be used with reference to any number of zones and/or its use may be prohibited with reference to any number of zones. Each zone may be associated in the product with conditional use of one or more functions of the product. A marker may transmit to a product information indicating one or more functions of the product that are subject to the condition of being used in the zone associated with the marker. The product may determine which function is to be enable or disabled according to a description of the zone. The description may be stored in the product (e.g., defined by the product manufacturer or distributor) and/or received from a network or from a marker.

A product having access to a server may communicate with one or more markers via any link or network. For example, the product may omit a receiver and instead include a transmitter (e.g., a beacon) or transponder permitting location of the product by any conventional position determining system (e.g., a scanner, a radio frequency identification interrogator, a conventional wireless access node or "hot spot", a cellular telephone system). The product may determine that it is in a zone by communication over a network link to a server having information about the detected location of the product's transmitter or transponder. The server may have or have access to a definition of the zone or zones for the product, determine whether the product is in a particular zone, and provide its conclusion to the product. The product's function of determining whether it is in a zone may be implemented in such a system by determining whether the information from the server indicates the product is in the zone.

For example, product 126 has access to information defining one zone (e.g., a description of expected communication from a marker) in which a particular set of functions is permitted. Following registration, product 126 ceases operating according to an unregistered state (or mode) and begins operating according to a registered state (or mode). In the registered mode of operation, product 126 receives a signal from marker 110, concludes that it is within the zone, and permits use of any one or more of the particular set of functions. Product 110 regularly tests whether it is in the zone by receiving a signal and comparing it to the expected communication. On failure to receive a signal matching the expected communication, product 126 concludes that it is not in the zone associated with marker 110 and disables use of the particular set of functions. Product thereafter re-enters the unregistered state wherein the particular set of functions cannot be performed by the product.

A listener includes any apparatus that determines that a function of the product is being performed and/or has been performed. A listener may report usage of the function in any conventional manner. A listener may provide a signal to any conventional system as notice to that system of the usage of the product. A listener may be packaged with such a system for monitoring wireless communication from conventional sensors. A listener may be packaged as an accessory module (e.g., sold as an after-market device) for such a system. For example, the conventional system may primarily serve as a monitor for facility safety (e.g., fire protection) and/or facility security (e.g., surveillance, intrusion alarm). A listener 112 may include a detector of the operation of a weapon such as an electronic control device and provide a signal to an intrusion alarm system (not shown) (e.g., overtly sound an alarm, covertly place a call to the police) in a manner of the type used by a conventional wireless remote "panic button" of such a system.

Figure 2A:
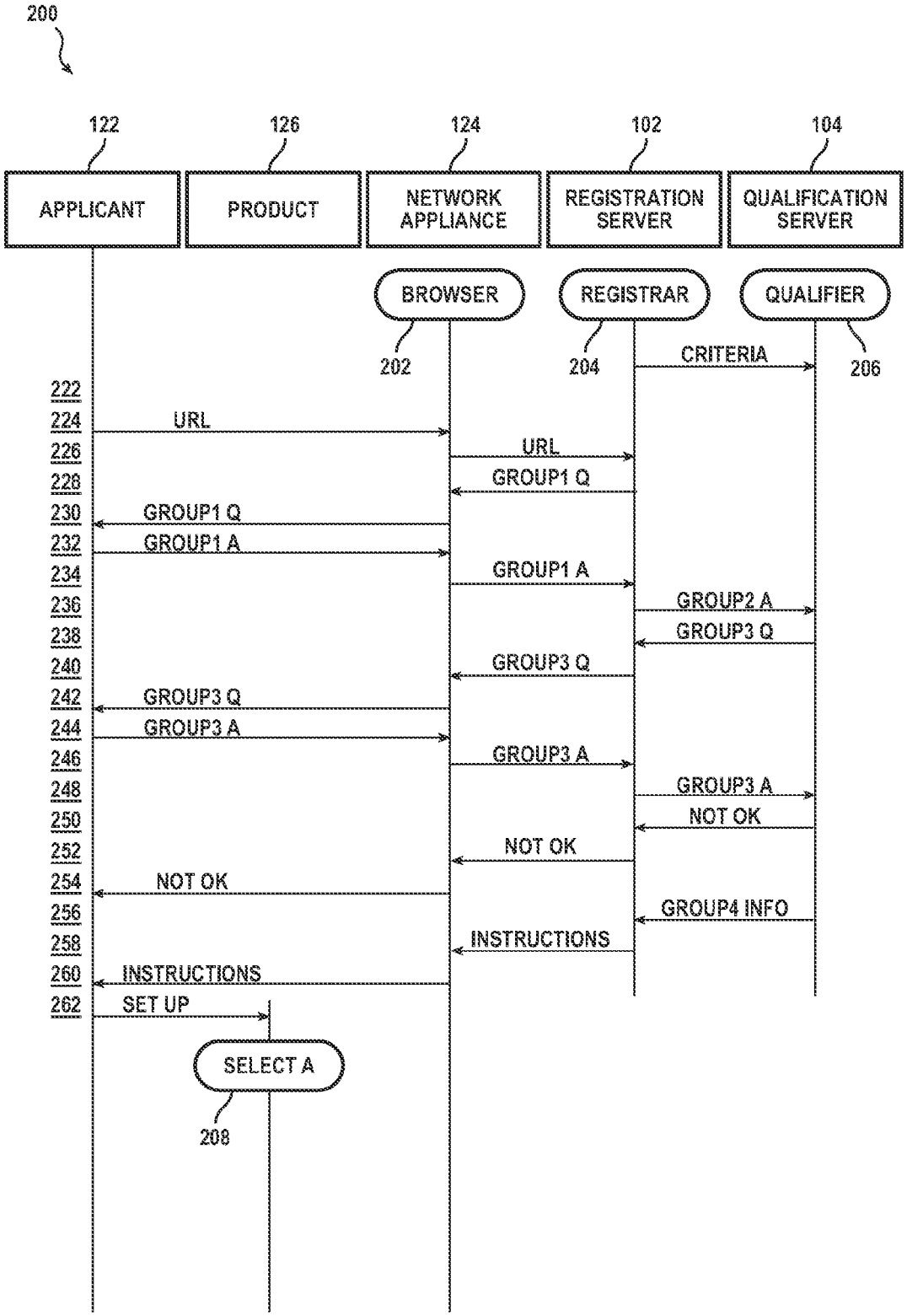
FIGS. 2A and 2B present a message sequence diagram of a method, according to various aspects of the present invention, for qualified registration in the environment of FIG. 1.
Figure 2B:
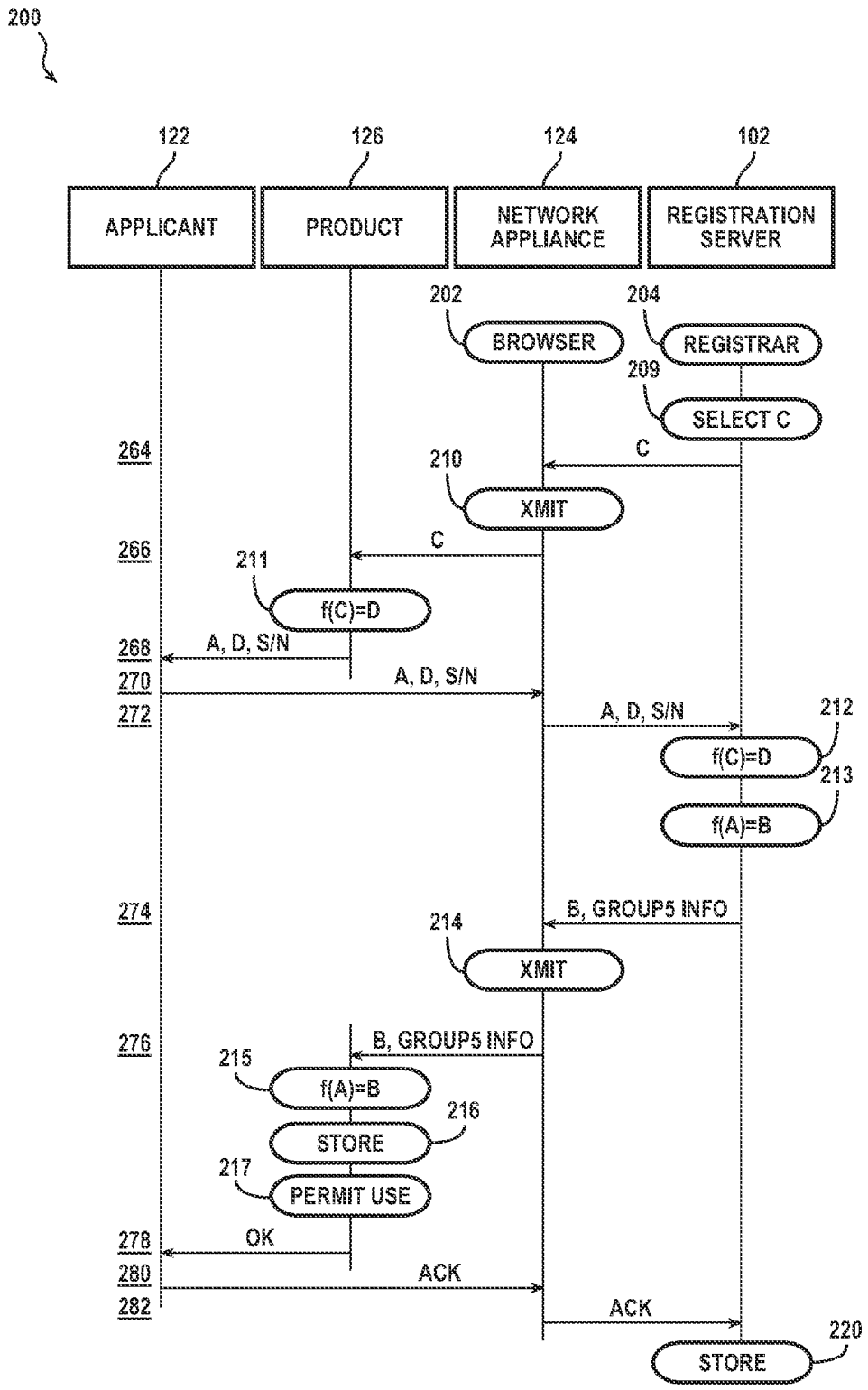

The servers and clients of environment 100 may cooperate for a qualified registration using signals and/or messages of the type described with reference to a sequence of messages 200. Sequence 200, of FIGS. 2A and 2B provides a plan for implementations of various aspects of the present invention. For example, in an important class of implementations, all of the illustrated communications occur in the order illustrated, proceeding in time vertically toward the bottom of the figure. Particular times are indicated 222 through 282. In other important classes of implementations the time sequence of communication may differ from that shown and/or some signals and/or messages may be combined or omitted. Some of these variations will be noted below. Others will be apparent to a person of ordinary skill applying the teachings herein.

Hereafter, for clarity of explanation, product 126 is referred to as weapon 126, though the full breadth of product 126 is intended. Conditional use of weapon 126 includes registration and operation within a zone. For other products, according to various aspects of the present invention, conditional use may include registration and/or operation within a zone. For an important class of implementations according to various aspects of the present invention, registration is omitted but any of the techniques discussed herein for operation within a zone are included.

In exemplary sequence 200, registration server 102 is managed by a manufacturer of product 126. Qualification server 104 is managed by a financial services organization able to gather and keep up to date personal information describing millions of persons (e.g., Checkpoint). In the implementation of sequence 200 discussed below, product 126 is a weapon, preferably an electronic control device (ECD), sold in an unregistered state.

For weapon 126, registration (e.g., exiting the unregistered state and entering a registered state) is conditional on qualified registration involving a criminal background check. For instance, an applicant for registration that is identified to a criminal background that includes a felony conviction or a violent misdemeanor is denied use of weapon 126.

For initialization and/or configuration management, registrar process 204, operating on registration server 102, as a one-time initialization or as needed for reconfiguration, may define qualifications (222) to qualifier process 206 operating on qualification server 104. Defined qualifications indicate to the qualifier process 206 what criteria are suitable for qualifying a registrant for the particular types of products expected to be registered. Qualifications of an applicant may include personal criteria (e.g., age, sex, race, appearance, height, weight) demographic criteria (e.g., nationality, languages, residence addresses and durations, employer names and durations) economic criteria (income history, income tax history, auto registrations, residence values, property tax history, credit activity, credit scores) and legal background criteria (criminal convictions, pending suits, traffic violations, liens, licenses, regulatory agency status)). Criteria may be stated as ranges, limits, acceptable alternatives, or unacceptable alternatives. Different dimensions may be weighted and combined for one or more comprehensive measures. The format of the information provided by registrar process 204 and qualifier process 206 may be specified (part of an agreed interface specification) to streamline communication. For registration of weapon 126, the requirement for no felony convictions may be part of the defined qualifications (222).

When applicant 122 has possession of weapon 126 to register, applicant 122 reads from the product packaging (or other printed material provided with weapon 126) some initial instructions explaining how to gain access to registrar process 204 via a browser 202 of network appliance 124. For a TCP/IP network, access generally requires input (224) of a uniform resource locator (URL) into browser process 202. Browser process 202 forwards (226) the URL to registrar process 204. Network appliance 124 may have a network address suitable for use as a qualification (e.g., a personal phone number or GSM address when network appliance 124 is a personal cellular phone, a MAC address or IP address when network appliance is a personal workstation). In other implementations, applicant 122 may use any network appliance (e.g., a public workstation at a public library) because sufficient identification criteria can be satisfied without the network address of network appliance 124.

Registrar process 204 responds (228) to the URL with one or more presentations that include information and questions (group one questions) presented (230) to applicant 122 by browser process 202. The information may teach the applicant that a person registered to use the product is presumed to be the exclusive user of the product. The information may further recommend ways to protect his or her reputation as a qualified person, for example, by employing recommended physical security measures suitable for the product. Group one questions may request information identifying the applicant and identifying the product (e.g., type of product). The type of product may be used to determine which of several sets of defined qualifications (herein also called criteria (222)) apply in this instance of qualified registration.

Information requested to identify the applicant may include name, date of birth, social security number, driver's license number, current address, telephone numbers, and/or current employer name.

Applicant 122 responds (232) with answers (group one answers) that are forwarded (234) by browser process 202 to registrar process 204. Registrar process 204 formats the information received and provides (236) a comprehensive set of answers (group two answers) to qualifier process 206. Group two answers are typically sufficient for qualifier process 206 to identify applicant 122 in records available to qualification server 104 (e.g., a database, not shown).

Qualifier process 206 may determine whether the group two answers meet the criteria stated or implied by the defined qualifications (222) (and possibly other qualifications used by the operator of qualification server 104) and respond to the group two answers with a result of qualification (250 or 256). In many cases, qualifier process 206 may seek additional information to assure identification, assure qualification, and/or to update its records. If so desired, qualifier process 206 may provide (238) to registrar process 204 additional questions (group three questions) that are forwarded (240, 242) to applicant 122. Group three questions may request a prior name, prior states where licensed to drive, children's or parent's names or birth dates, prior addresses, and/or names of prior employers. Applicant 122 provides (244) another group of answers (group three answers) that are forwarded (246) by browser process 202 and forwarded (248) by registrar process 204 to qualifier process 206. Group three questions may require knowledge of information very likely exclusively known by applicant 122. Group three questions establish the identity of applicant 122 to a degree of certainty that may be specified by defined qualifications and/or by qualifications set by the operator of qualification server 104.

Consequently, qualifier process 206 may issue (250) indicia of a failure of qualification that is forwarded (252, 254) subsequently to the applicant. In accordance with defined qualifications (222) or a policy of qualification server 104 management (e.g., describing types of information for registrar process 204), qualifier process 206 may provide (250) information in addition to mere binary indicia of failure status for storage by registrar process 204. A failure of qualification terminates qualified registration and dispenses with the client-server session (if any) regarding the initial request (224). Note that the product function requiring qualified registration has not been enabled and is consequently not allowed to be used. Any information describing the registration attempt that may have been handled by registrar process 204 may be stored by registrar process 204 on registration server 102. Any information describing the qualification attempt that may have been handled by qualifier process 206 may be stored by qualifier process 206 on qualification server 102.

On the other hand, if qualification is determined by process 206 to be successful (e.g., all criteria are met within acceptable limits), indicia of qualification is provided (256) to registrar process 204. Additional information besides a binary result of qualification may be included as group four information. Registrar process 204 may retain the group four information until a trusted channel is established between registrar process 204 and product 126.

If the additional requirements for trusted communication between registrar process 204 and product 126 need not be met (e.g., undesired complexity), messages and/or signals 264 through 272 may be omitted and consistent revisions made to the remaining communications. In such a simplified implementation of sequence 200, instructions may next be provided (258) by registrar process 204 to browser process 202 and presented (260) to applicant 122. Instructions inform the applicant how to prepare the product for communication with network appliance 126. Applicant 122 performs (262) product configuration according to the instructions and may physically position and/or orient product 126. For example, when product 126 is a weapon having a safety switch and having an interface to a network appliance that includes a receiver for detecting a series signal modulated with a self clocking code and produced by a portion of a conventional CRT monitor display of an otherwise conventional workstation implementation of network appliance 124, then the instructions may direct the applicant to (a) set the safety switch to the "on" position so that power is applied to the receiver and other circuits of the weapon; (b) hold the weapon against the face of the monitor and within an outline presented to the applicant on the monitor (e.g., with the instructions) so that the receiver is aligned immediately adjacent the portion of the display surface that is modulated for communication to the weapon; and (c) refrain from moving the weapon away from the face of the monitor or outside of the outline for at least a suggested minimum period of time (e.g., two minutes) or until complete registration is indicated (278) by a user interface of the weapon.

While the product is set up for communication with network appliance 124, group five information may be provided (274) by registrar process 204 to browser process 202 and forwarded (276) to product 126. Group five information may include all, some, or none of group four information; and, may further include any information available to registrar process 204 such as identification of a particular registrar process 204, registration server 102, qualifier process 206, qualification server 104, duration, date and time of qualification and/or registration, any portion of the defined qualifications (222), any portion of group one answers, and/or any portion of the group three answers. Product 126 may store (216) this information for each registration session completed successfully to provide a record that may be useful to a law enforcement agency if, for example, the product is found at a crime scene or is used at a crime scene. Product 126 may indicate (278) to the applicant that qualified registration is completed. And, registrar 204 may store (220) indicia of acknowledgement received (280, 282) from product 126.

If trusted communication is desired, instructions may be provided (260) to applicant 122 and set up (262) of product 126 for communication with network appliance 126 may occur as discussed above. A requirement or purpose of trusted communication may be (but need not be) described in these instructions.

Trust may be established between communicating entities as disclosed below. Other implementations according to various aspects of the present invention may include exchange of encryption keys, installing private encryption keys or secrets in the entities prior to communication, exchanging keys using Diffie-Hellman technology, using a public key infrastructure, or certificate verification.

In the methods described below, a nonce may be of any fixed or variable length depending on the capability of the product, the user interface to the product, the network appliance, and the interface between the product and the network appliance.

A process that determines that the source of information product 126 receives can be trusted by product 126 protects product 126 from accepting as legitimate, and taking action on, an unauthorized message or signal perhaps sourced from a system (not shown) operated to subvert qualified registration. Product 126 may establish that the source of information it receives can be trusted by selecting (208) and providing (268) a nonce (A) to the source of information and determining that a subsequently received (276) reply (B) is consistent with the nonce (A). Consistency arises because product 126 and the trusted source (204) are expected to have identical instances (213, 215) of a process for calculating the reply (B) for any given nonce (A).

The nonce (A) for a particular registration may be selected by each product and for each qualified registration session in a pseudo random manner. In one implementation, every product has an identical pseudo random number process (208). A seed for a particular nonce (A) may be prepared in accordance with information particular to the instance of the product 126 and/or the instance of the registration session. Instructions presented (260) to applicant 122 may direct applicant 122 to enter (262) information into product 126 as part of the set up for communication with network appliance 124. Such information may be used by nonce selection process 208 to select a nonce (A).

Information particular to the instance of product 126 may include a serial number of product 126 stored in the product at time of manufacture; and/or a description of a transaction that led to possession of the product by applicant 122. Instructions provided (260) to applicant 122 may guide applicant 122 to input to product 126 during set up (262) a description of a transaction. A description of a transaction may include an identifier of the person or entity that provided the product to the applicant (e.g., a seller's name, seller's tax identification number, seller's phone number, a uniform product code (UPC)), a location of the transaction (e.g., seller's GPS coordinates, seller's postal code), buyer's credit card number, and/or a date/time of the transaction (e.g., deduced by product 126 upon a first operation of a control of the product's user interface after product 126 is removed from its sales packaging).

Information particular to the instance of the current registration session may include a description of the session and/or a description of the applicant. A description of the session may include a date/time of the session, duration from start of session, a location of the session (e.g., current GPS coordinates, a local postal code, a local phone number) and/or any particulars of network appliance 124 such as a network address or disk space remaining. A description of the applicant may include any information provided in group one answers (234) or group three answers (246) discussed above, applicant's residence postal code, applicant's residence/employer/cellular phone number, and/or applicant's response to a request for an arbitrary number (e.g., as explained in instructions (260)).

After selecting a nonce (A), product 126 may provide (268) the nonce (A) to applicant 122, via the product's user interface. Involving applicant 122 and user interfaces of product 126 and network appliance 124 greatly reduces the risk that an automated substitute for a person as applicant can be created for subversive purposes. Any technology for distinguishing a human may be used (e.g. a completely automated public turing test to tell computers and humans apart (CAPTCHA)). For example, product 126 may have a display by which applicant 122 may read nonce (A) as a numeric or alphanumeric value. For another example, product 126 may have a display by which applicant 122 may read nonce (A) as an image (e.g., an arbitrary hand drawn symbol such as a grid with particular squares blackened). For still another example, product 126 may have a speaker by which applicant 122 may direct sound into a microphone of network appliance 124 to convey an audio signal comprising nonce (A) (e.g., a self clocking shift keyed series digital signal, a synthetic voice reciting an arbitrary word or phrase such as a name of a city). Applicant may then enter (270) the nonce (A) into network appliance 124 in any conventional manner including as discussed above, or as an answer to a multiple choice question (e.g., for describing an image on a display of product 126), or as a series of answers to a series of multiple choice questions. Browser process 202 may forward (272) the nonce (A) (or applicant's entries) to registrar process 204.

Registration server 102 hosts process 213 to compute a reply (B) and provide (274) the reply (B) to browser process 202. Transmit to product process 214 may forward (276) the reply (B) to product 126. Product 126 hosts process 215, identical to process 213, to compute a value from nonce (A). If that value is consistent with the reply (B), then the source (registration server 102) is considered trustworthy by product 126. If not, product 126 terminates processing for the current registration session and may store 216 information describing the unsuccessful registration session. Termination prevents permitting use 217 of the intended product function. Termination also prevents presenting (278) an indication of successful registration to applicant 122 and acknowledgement (280, 282) from reaching registrar process 204.

A process that determines that the source of information received by registration server 102 can be trusted by registration server 102 protects registration server 102 from reverse engineering that could otherwise guide the design of a subversive apparatus for registering a product function without completing qualified registration with a legitimate registration server 102. Registration server 102 may establish that the source of information is a legitimate product 126 to be trusted (as opposed to a subversive apparatus) by selecting 209 and providing (264) a nonce (C) to the source of information and determining that a subsequently received (272) reply (D) is consistent with nonce (C). Consistency arises because the registration server and the trusted source are expected to have identical instances (211, 212) of a process for calculating the reply (D) for any given nonce (C).

The nonce (C) for a particular registration may be selected by each registration server and for each qualified registration session in a pseudo random manner. In one implementation, every registration server has an identical pseudo random number process (209). A seed for a particular nonce (C) is prepared in accordance with information particular to the instance of registration server 102 and/or the instance of the registration session. An authorized operator of registration server 102 may define and enter information discussed above into memory (not shown) of registration server 102. Such information may be used by nonce selection process 209 to select a nonce (C).

Information particular to the instance of registration server 102 may include a serial number of registration server 102 stored in registration server 102 at time of manufacture; and/or a description of a configuration of registration server 102. A description of configuration may include an identifier (e.g., network address), a location of the server presumed to be constant (e.g., facility GPS coordinates, facility postal code), and/or a date/time of establishing its configuration.

Information particular to the instance of the current registration session may include a description of the session and/or a description of applicant 122. A description of the session may include a date/time of the session, and/or a location of the session (e.g., current GPS coordinates, a local postal code, a local phone number). A description of applicant 122 may include any information provided in group one answers (234) or group three answers (246) discussed above, applicant's residence postal code, applicant's residence/employer/cellular phone number, and/or applicant's response to a request for an arbitrary number (e.g., obtained in response to the group one questions).

After selecting a nonce (C), registrar process 204 may provide (264) the nonce (C) to browser process 202. Browser process 202 may then forward (266) the nonce (C) to product 126 via transmit to product process 210. Product 126 hosts process 211 to compute a reply (D) and present (268) the reply (D) to applicant 122 via a user interface or output device of product 126. Applicant 122 determines the reply (D) and other information (e.g., product 126 serial number) in any conventional manner from a user interface of product 126. Applicant 122 inputs into network appliance 124 the reply (D) and other information (e.g., a serial number of product 126) into any input device of network appliance 124 and in any conventional manner. For example, product 126 may have a display from which applicant 122 may read reply (D) and network appliance 124 may have a keyboard by which applicant 122 may type in reply (D). For another example, product 126 may have a display (or speaker) and network appliance 124 may have a camera (or microphone) by which applicant 122 holds the display in view of the camera (or speaker within range of the microphone) to complete the entry of reply (D) into network appliance 124. Reply (D) may be an image (e.g., any two dimensional symbol, a bar code). Reply (D) may be sound (e.g., a self clocking shift keyed series of audio tones, a synthetic voice reciting a word or phrase). Browser process 202 forwards the reply (D) to registration server 102. Registration server 102 hosts process 212, identical to process 211, to compute a value from the nonce (C). If that value is consistent with the reply (D), then the source of information (product 126) is considered trustworthy by registration server 102. If not, registration server 102 terminates processing for the current registration session. Termination prevents providing (274) indicia of successful registration to browser process 202. Consequently, termination prevents permitting use 217 of the intended product function and prevents presenting (278) an indication of successful registration to applicant 122.

According to various aspects of the present invention, a product may present via a user interface its serial number and a code. Use of the code makes reverse engineering unlikely to be successful and unauthorized registration of product functions unlikely. The serial number may be used by a registration server to create an entry in a database that associates identification of a successful registration applicant with identification of a product (e.g., the product's serial number). Typically, the serial number of a product is evident from an inspection of the product even if the product is not functional. If the serial number is communicated to the registration server in an encrypted form, reverse engineering to crack the encryption may be guided by knowledge of the serial number and a presumption that the registration server would receive a product serial number from the product during qualified registration. Consequently, the security provided by encryption would be compromised. Accordingly, the serial number, in a preferred implementation of a system in accordance with various aspects of the present invention, is provided in an unencrypted form. Nevertheless, the conclusions of trustworthy sources of information as discussed above are not compromised because use of the code makes reverse engineering unlikely to be successful and unauthorized registration of product functions unlikely.

Figure 2C:
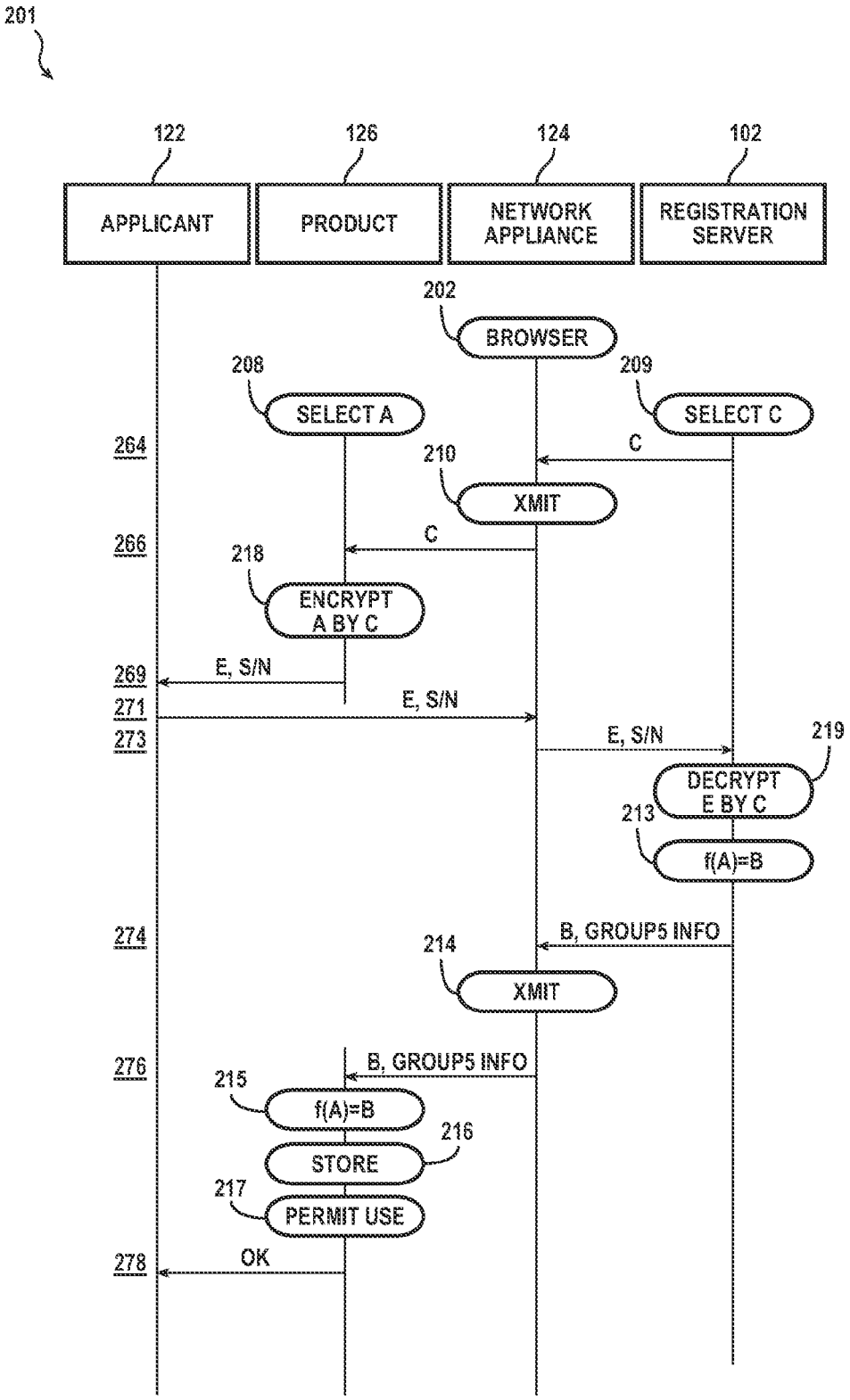
FIG. 2C is a message sequence diagram of another method, according to various aspects of the present invention, for qualified registration in the environment of FIG. 1.

A variation of sequence 200 replaces messages and/or signals 264 through 278 of FIGS. 2A and 2B with sequence 201 having messages and/or signals 264 through 268 of FIG. 2C. To limit the quantity of information presented to applicant 122 and subsequently input by applicant 122 to network appliance 124, providing (268), inputting (270), and forwarding (272) reply (D) as discussed above with reference to FIGS. 2A and 2B may be omitted. Instead, referring to FIG. 2C, a code (E) may be provided (269), inputted (271), and forwarded (273) with the serial number of product 126. The code (E) may be computed by applying encryption to nonce A using a key of nonce C. When registration server 102 receives (272) the code (E), knowledge of nonce C (from process 209 hosted by registration server 102) is sufficient for registrar process 204 to decrypt the code (E) to determine nonce A. Registration server 102 may conclude that the source of information that provided the code (E) is trustworthy because product 126 and registration server 102 have compatible encryption and decryption processes (218 and 219).

Figure 2D:
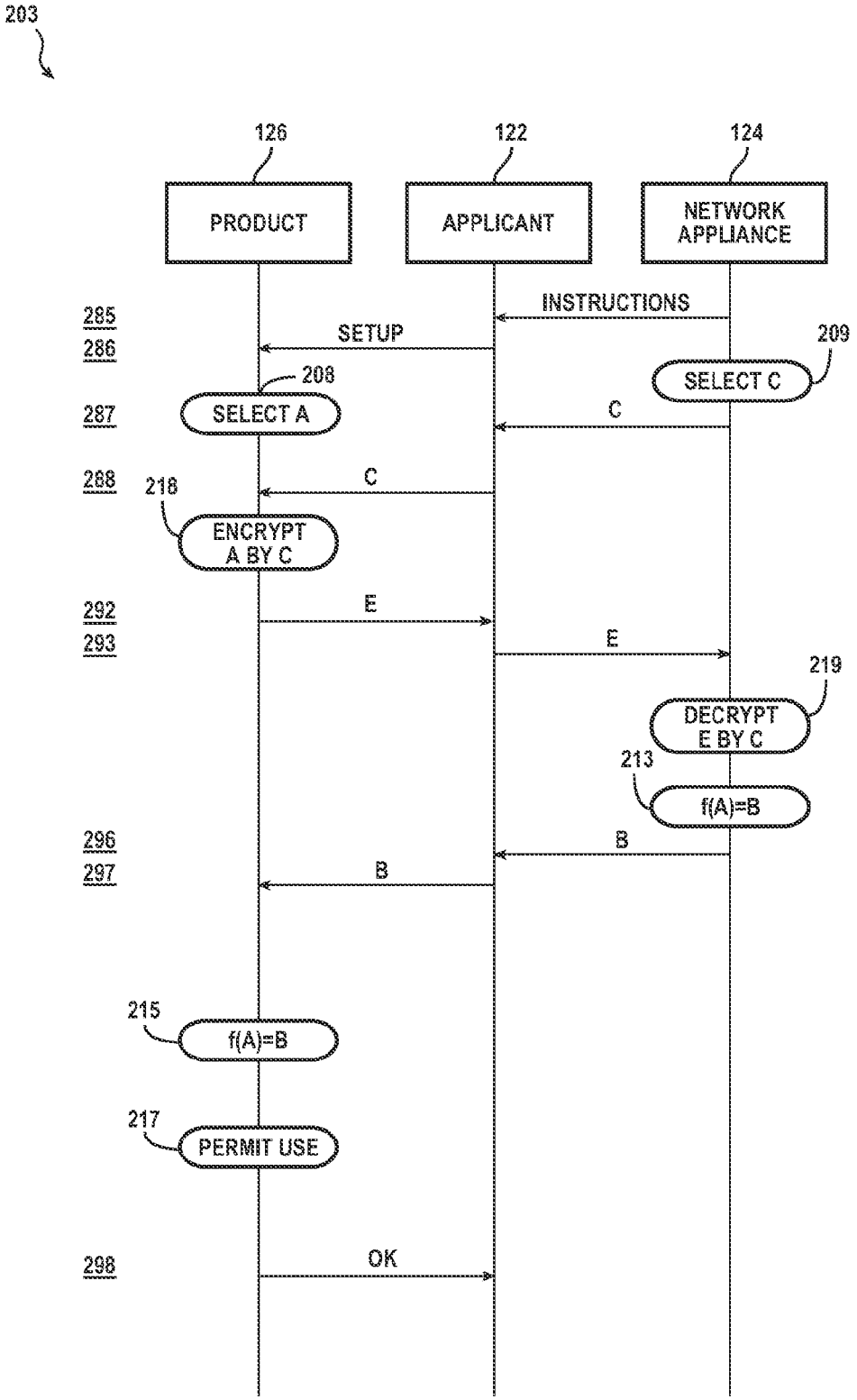
FIG. 2D is a message sequence diagram of another method, according to various aspects of the present invention, for qualified registration in the environment of FIG. 1.

Another variation of sequence 200 replaces messages and/or signals 260 through 278 of FIGS. 2A and 2B with sequence 203 having messages and/or signals 285 through 298 of FIG. 2D. In sequence 203, an applicant communicates with a network appliance; and a product communicates with the applicant. A simpler user interface on the product may result. For example, in sequence 203, network appliance 124 may provide to applicant 122 instructions (285) that explain how to prepare (286) the product for receiving information. Applicant may operate the product (SET UP) according to the instructions (285). Network appliance, after a suitable allowance for product set up, or after a signal (not shown) from applicant 122, performs a process to select (209) a nonce (C) and provides (287) the nonce (C) to applicant 122. For a network appliance having a browser 202 and display, the nonce (C) may be presented visually to the applicant 122 as a string of letters, digits, or symbols and may use CAPTCHA technology as discussed above. For an audio network appliance, a human or synthetic voice may enunciate the nonce (C) to the applicant 122. Using a user interface of product 126, applicant 122 enters (288) the nonce (C) into the product. Product 126 may perform processes (e.g., analogous to 208, 218) for selecting a nonce (A) and for encrypting the nonce (A) in accordance with the received nonce (C). Using a user interface of product 126 (e.g., the same or different from entry at 288), product 126 may provide (292) to applicant 122 a reply (E) that applicant 122 enters (293) into network appliance 124 (e.g., via a keyboard or by speaking). In response to the reply (E), network appliance 124 may decrypt (219) the reply (E) in accordance with nonce (C) to determine a value (e.g., A); and then determine (213) a second nonce (B). Nonce (B) may then be provided (296) to applicant (122) and entered (297) by applicant in product 122 in a manner analogous to handling of the first nonce (C). The product 122 may test (215) the authenticity of the second nonce (B) and if authentic permit use (217) of some or all of the functions of the product. The product may report (298) status of registration (e.g., OK or not OK) to applicant 122.

Sequence 203 illustrates omission of the product providing a serial number as may be desired in a particular implementation to simplify communication possibly at the expense of recording the serial number of a registration by registrar process 204. In another implementation of sequence 203, signals, messages, and processes for establishing trust are also omitted as may be desired to simplify the product and/or the user interaction with the product. For example, processes 208, 209, 218, 219, 213, and 216 are omitted, messages for nonces (C), (E), and (B) are omitted, and network appliance 124 simply provides with instructions (286) sufficient information to permit use (217) of some or all of the functions of the product.

A user interface for inputting information (e.g., a nonce or registration code) into a product may be implemented with a product that includes a switch and an indicator. The switch may be operated by the user who places the switch in one of two or more positions. By placing the switch in a predefined position, toggling between positions, or in a sequence of positions according to a switching schedule over time, a processor of the product may determine that the user intends to enter particular information. For example, the following actions by a user according to a predefined switching schedule may be interpreted by the processor as a request to enter a mode of operation for qualified registration (e.g., SET UP): placing an on/off switch in the "on" position, waiting about 1 second, toggling the switch (on/off/on), waiting about 1 second, toggling the switch a second time, and waiting for more than about 2 seconds with the switch in the "on" position. As another example, the following actions by a user according to a second predefined switching schedule may be interpreted by the processor as input of a digit a string used as a nonce or registration code: with the switch in the "on" position, waiting a duration proportional to the digit, and setting the switch to the "off" position. The product may include an indicator (e.g., an LED) that indicates intervals of time (e.g., with a flash of light that the user counts) for an integer number of time intervals corresponding to the digit being entered. The entry of a series of digits may proceed by repeating the second switching schedule. Each repetition when completed may be acknowledged by the product (e.g., stopping flashing of the LED by leaving the LED on for a predetermined time such as about 5 seconds).

A user interface for outputting information (e.g., a nonce, mode, or status indication) from a product may be implemented with a product that includes a switch and an indicator. The switch may be operated by the user who places the switch in one of two or more positions. By placing the switch in a predefined position, toggling between positions, or in a sequence of positions according to a switching schedule over time, a processor of the product may determine that the user intends to receive particular information. After completing inputting as discussed above, the product may provide information without further prompt by the user (e.g., after a suitable delay to allow the user to be ready to receive information). For example, the indicator (e.g., an LED) may be flashed for the user to count the flashes and held on or off to indicate the end of flashing of each digit of information.

Use of one or more indicators for inputting information and for outputting information may be distinguished by use of more than one indicator and/or use of a different type of indicator (e.g., colors of light, types of sounds, varieties of vibration) for each purpose. For example, inputting and outputting may be juxtaposed or interleaved when inputting comprises flashes red light and outputting comprises flashes of green light.

The interfaces described above between an applicant and a product may be automated in any suitable manner for an implementation of interfaces between the product and a network appliance.

A product, according to various aspects of the present invention, may include a state machine with particular states and transitions between states. The state machine may be implemented as a processor (e.g. processing circuit, stored program processor, logic circuit, microprocessor, microcontroller). A logic circuit may implement states using memory (e.g., flip flops). A processor may implement states using memory (e.g., a program pointer, a stack of program pointer values, a register of condition values). Any desired amount of processing may occur while the state machine remains in a particular state. From the point of view of product 126, qualified registration may involve six states. For example, state transitions 300 of FIG. 3A for product 126 (e.g., a weapon as discussed above) include unregistered state 302, receive state 304, ask state 306, receive state 308, test state 310, and registered state 312.

In unregistered state 302, the state machine awaits action by the user of product 126 (e.g., applicant 122 at 262 as discusses above). On recognizing that action by the user (e.g., set up) is complete, the state machine transitions from unregistered state 302 to receive state 304. Unregistered state 302 may be a low power consumption state having little if any processing. In one implementation processing is limited to occasionally verifying that set up is not yet complete. In another implementation, state 302 does not permit any processing and set up includes applying power to the state machine that initially begins in state 304.

In receive state 304, the state machine awaits reception (266) of nonce C. Because nonce C cannot be predicted by product 126, nonce C may be formatted in a message provided by transmit to product process 210 in any conventional manner with predictable information so that the message as a whole conforms to an expected format to avoid misunderstanding noise as a value for nonce C. Select nonce (A) process 208 may be accomplished while in receive state 304. On receiving nonce C, the state machine transitions to ask state 306. Time may be measured (e.g., counted down) in receive state 304 to allow a reasonable duration for set up to be completed by applicant 122. If a timeout occurs while in receive state 304, the state machine transitions back to unregistered state 302. In a simplified implementation, ask state 306 and receive state 308 may be omitted; and transition from receive state 304 may be made directly to test state 310 (e.g., C is entered at a user interface by applicant 122).

In ask state 306, process 211 (FIGS. 2A and 2B) or process 218 (FIG. 2C) is performed and a presentation, message, or signal is formed. The presentation, message, or signal may in addition include a nonce (A), a reply (D), and/or a serial number of product 126. When prepared, the presentation, message, or signal is presented (268) to applicant 122 using a user interface or other output device of product 126. Time may be measured (e.g., counted down) in ask state 306 to allow a reasonable duration for transfer of the information conveyed by the presentation, message, or signal to be accommodated by network appliance 124. When timeout occurs, the state machine transitions from ask state 306 to receive state 308.

In receive state 308, the state machine awaits reception (276) of a reply B and group five information (if any). Reply B and group five information may be formatted in a manner analogous to the formatting of nonce C discussed above. When reception is complete, the state machine transitions to test state 310. Time may be measured (e.g., counted down) in receive state 308 to allow a reasonable duration for registrar 204, network communication with network appliance 124, and any further instructions or set up (not shown) to be completed by applicant 122. If a timeout occurs while in receive state 308, the state machine transitions back to unregistered state 302.

In test state 310, the state machine may perform process 215 and conclude whether registration of the intended function of product 126 may occur. If process 215 indicates registration is unsuccessful, an error presentation, message, or signal may be provided to applicant 122 or on a link to registration server 102 as discussed above. After a reasonable delay for presentation of the error message to applicant 122, the state machine transitions back to unregistered state 302. If, on the contrary, process 215 indicates that the source of received information may be trusted and registration was successful, then state machine 310 may perform processes 216 and 217, advise (278) applicant 122, and transition to registered state 312.

Figure 3A:
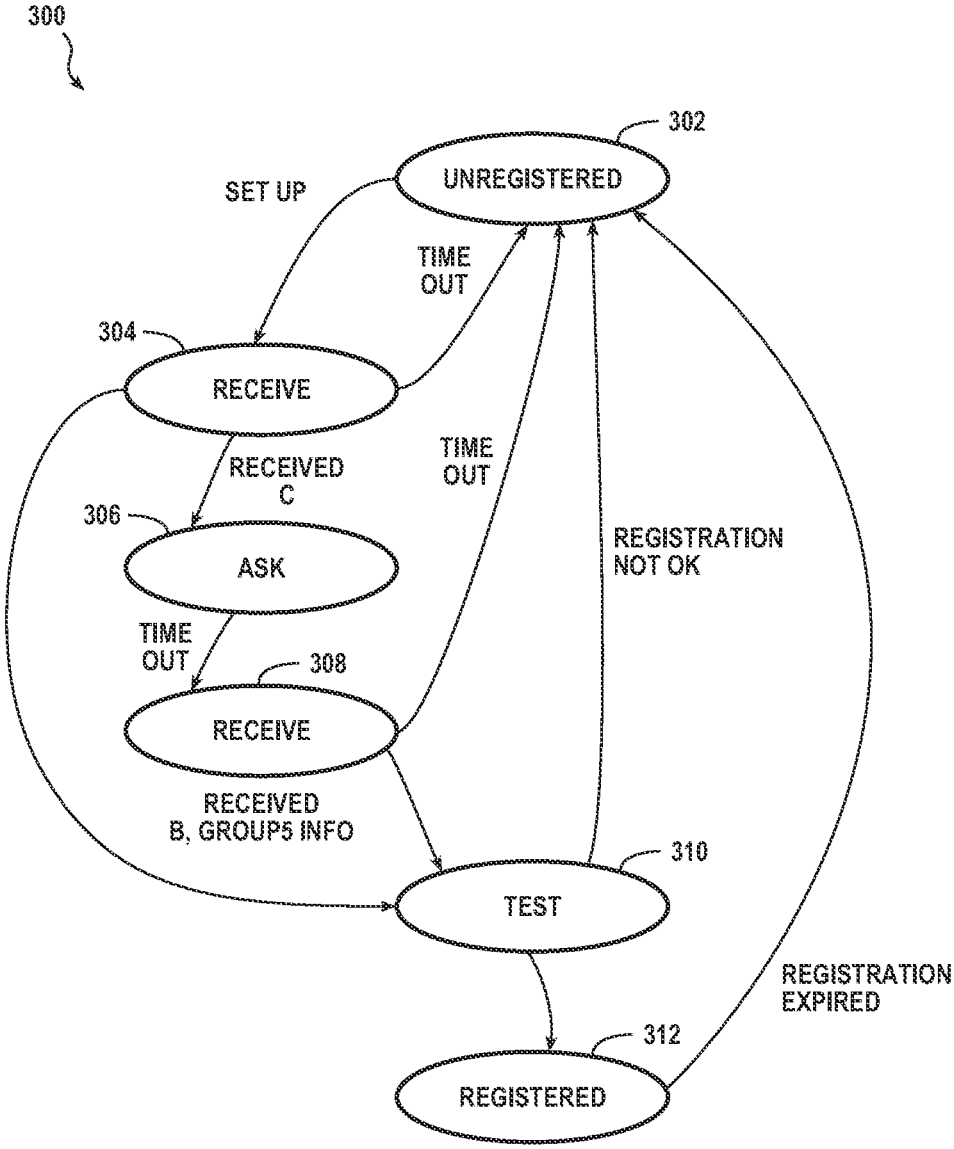
FIG. 3A is a state transition diagram of a logic circuit, according to various aspects of the present invention, of the product of FIG. 1.
Figure 3B:
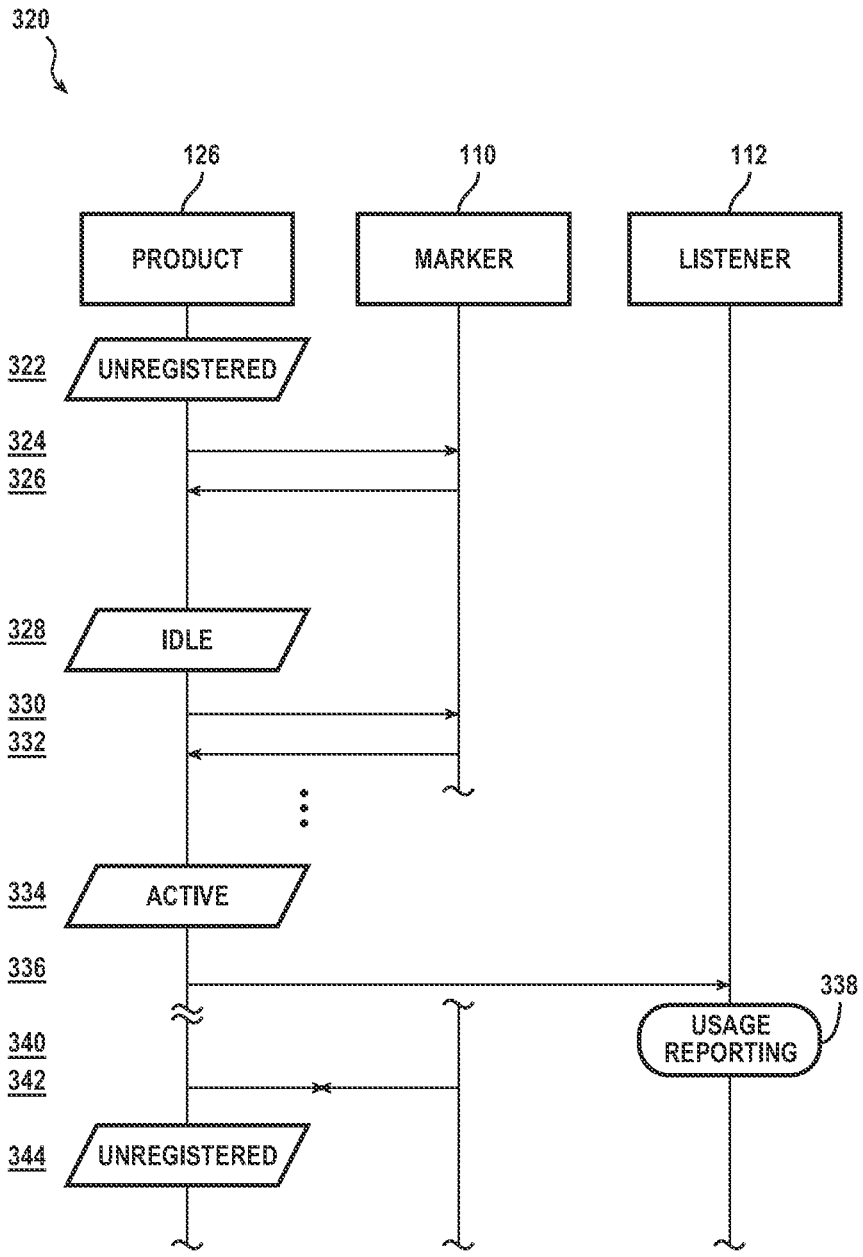
FIG. 3B is a communication sequence diagram of a method, according to various aspects of the present invention, for enabling use, reporting use, and disabling use of the product of FIG. 1.
Figure 3C:
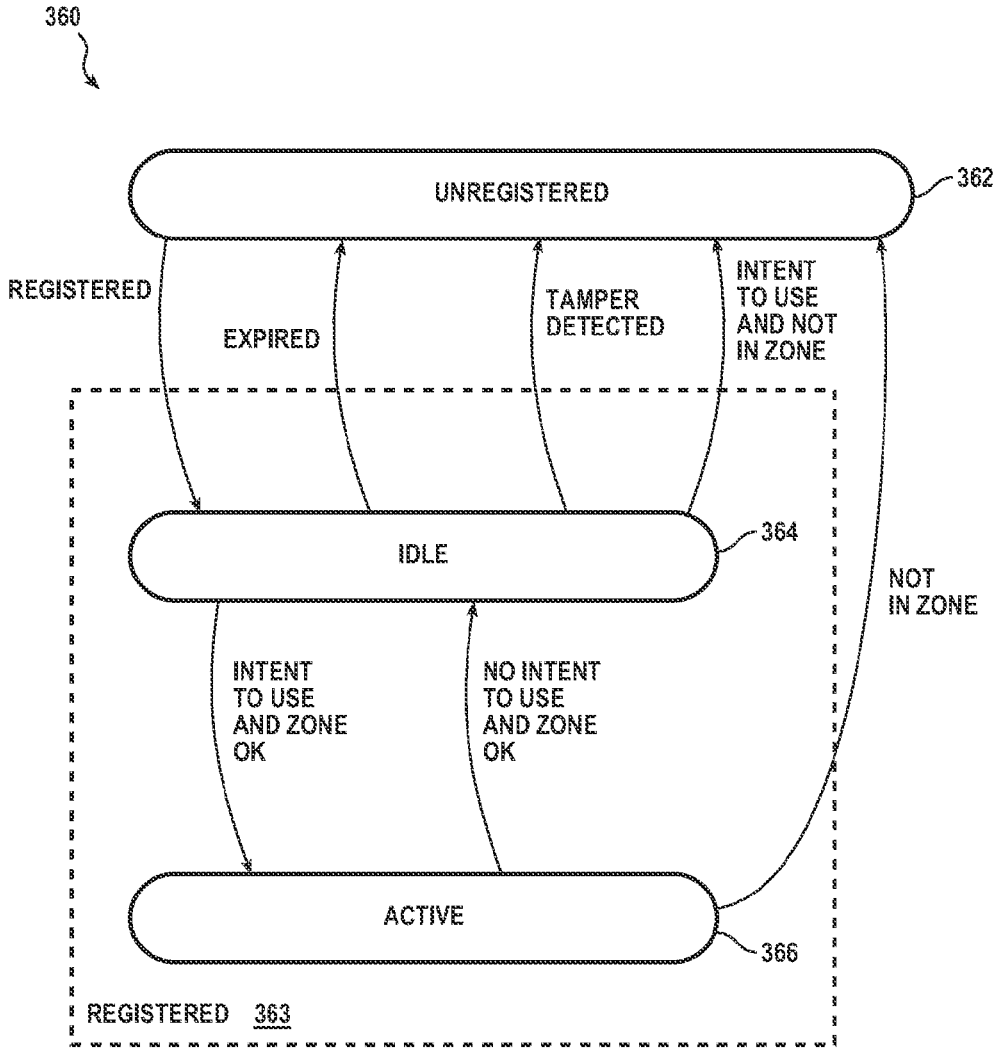
FIG. 3C is a state transition diagram of a logic circuit, according to various aspects of the present invention, of the product of FIG. 1.
Figure 4:
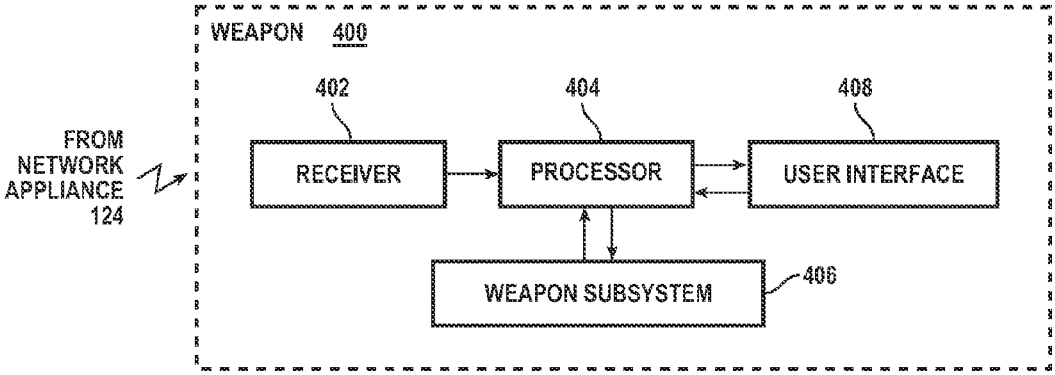
FIG. 4 is a functional block diagram of a weapon subject to conditional use, according to various aspects of the present invention.
Figure 5:
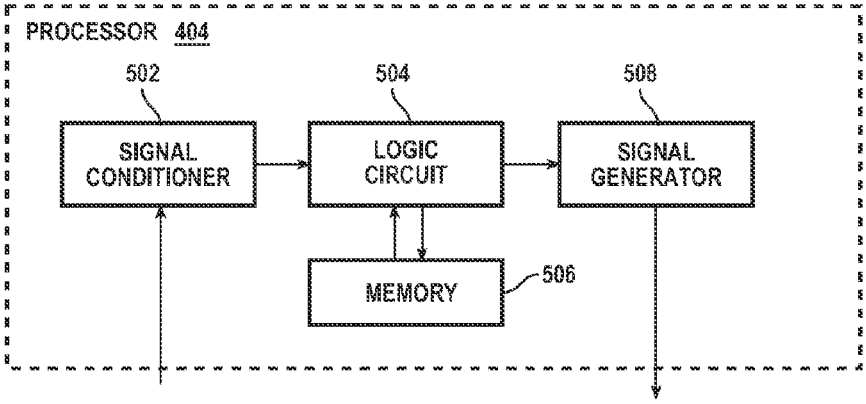
FIG. 5 is a functional block diagram of a processor of the weapon of FIG. 4.
Figure 6:
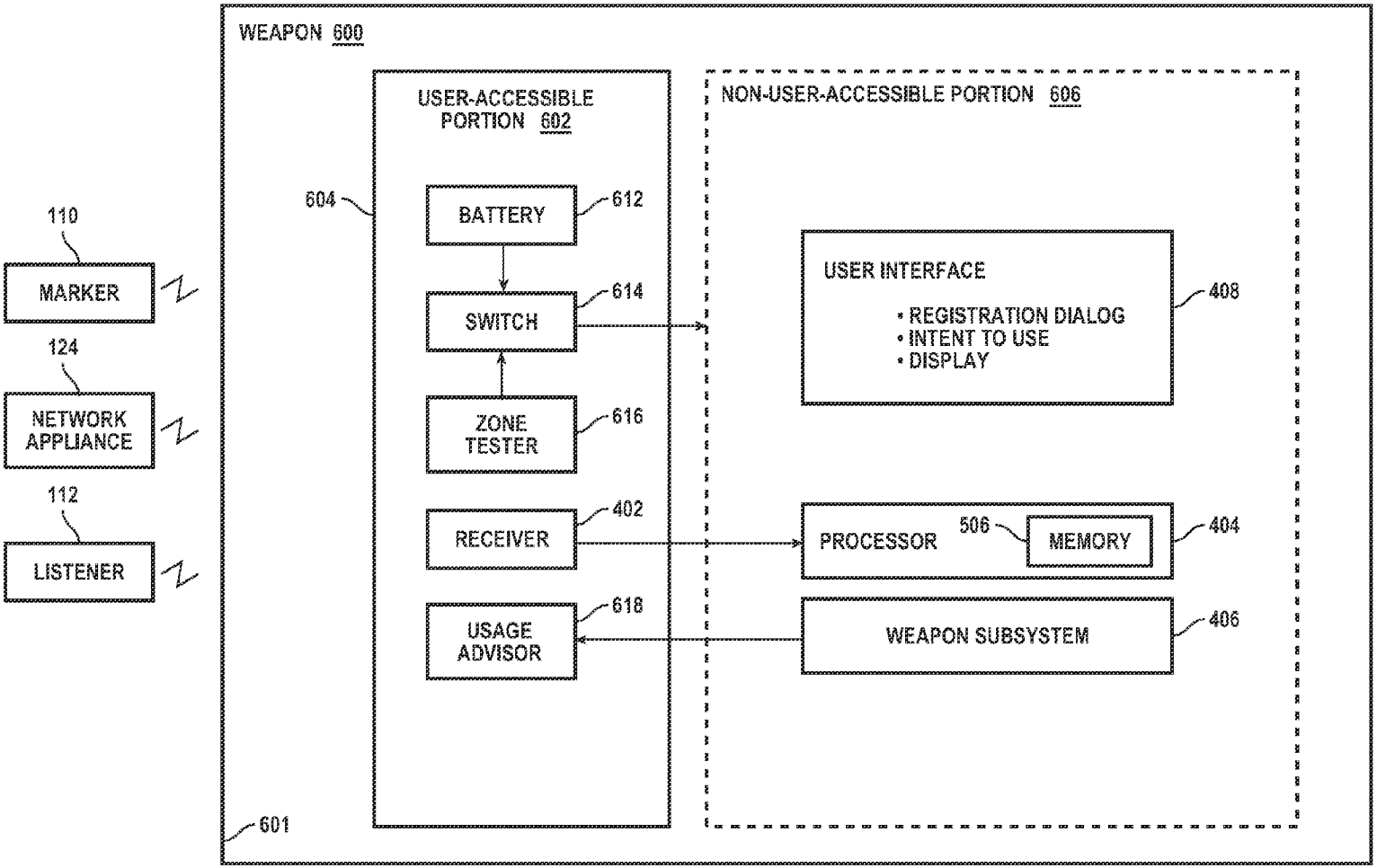
FIG. 6 is a functional block diagram of another weapon subject to conditional use, according to various aspects of the present invention.
Figure 7:
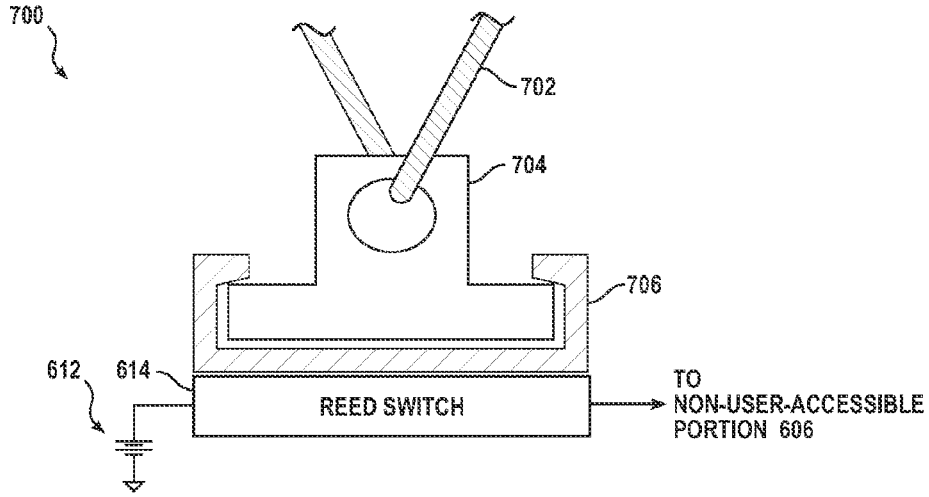
FIG. 7 is a functional block diagram that includes a cross-section of mechanical components for a zone tester, of the weapon of FIG. 6.
Figure 8:
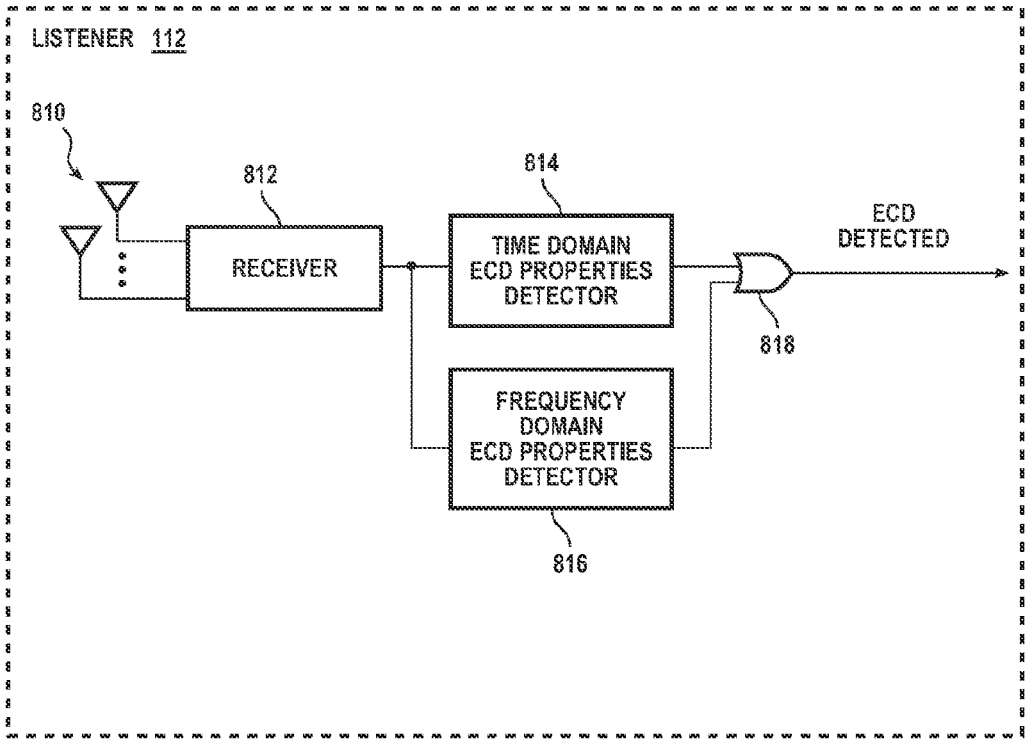
FIG. 8 is a functional block diagram of the listener of FIG. 1, according to various aspects of the present invention.
Figure 9:
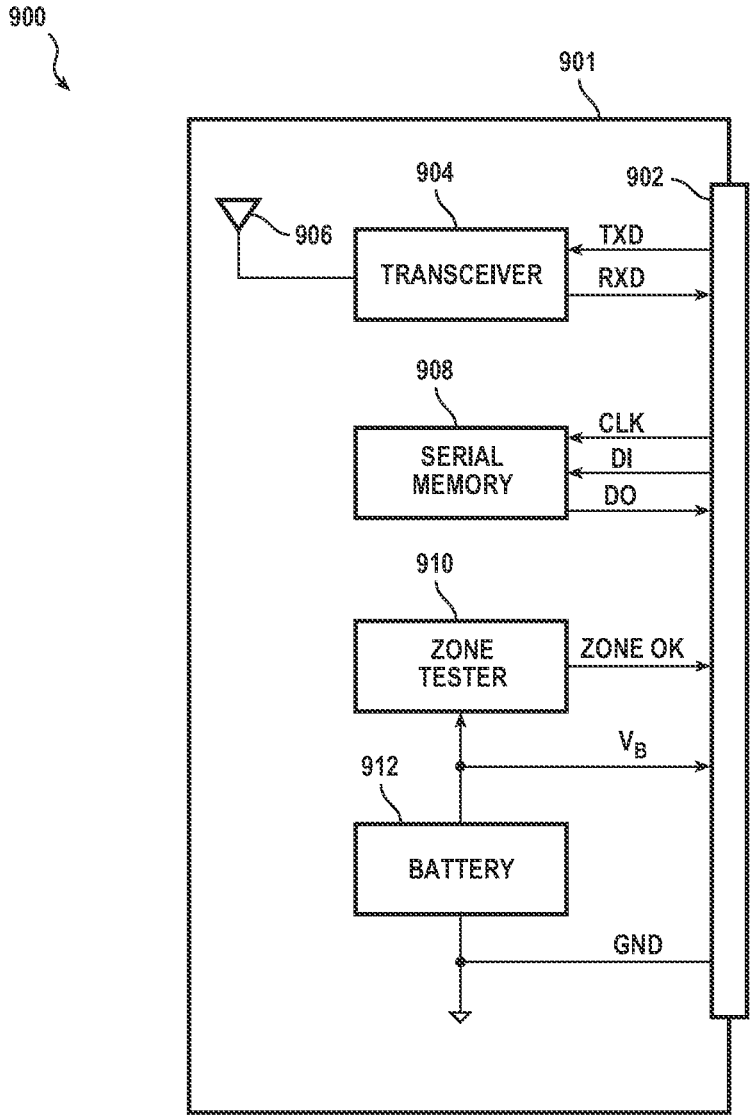
FIG. 9 is a functional block diagram of an assembly for upgrading an electronic control device, according to various aspects of the present invention.

As discussed above, product 126 may communicate with a marker and or a listener. Communication may include one or more signals and/or messages. Communication sequence 320 of FIG. 3B provides a plan for implementations of various aspects of the present invention. For example, in an important class of implementations, all of the illustrated communications occur in the order illustrated, proceeding in time vertically toward the bottom of the figure. Particular times are indicated 322 through 344. In other important classes of implementations the time sequence of communication may differ from that shown and/or some signals and/or messages may be combined or omitted. Some of these variations will be noted below. Others will be apparent to a person of ordinary skill applying the teachings herein. In the following discussion, Product 126 may communicate with one or more markers (110) and one or more listeners 112. Communication may include, in a manner suitable for the type of communication technology, outputting a signal (e.g., electrical, magnetic, optical, radio), broadcasting a message (modulated, formatted, synchronized), directing a transmission to a particular physical direction, and/or directing a message to a particular group or unique address any of which is subsumed herein for clarity of presentation in the phrase 'sending a signal'. In an unregistered state (322), product 126 may include in any registration method discussed above the step of determining whether product 126 is in a first suitable zone (e.g., at a product dispensary, at an armory, equipped with a suitable fob or smartcard). Determining whether the product is in a zone may include sending a signal (324) that is received by marker 110 and receiving (326) a response signal sent by marker 110. In a variation, sending (324) by product 126 is omitted because sending (326) by marker 110 is spontaneous (e.g., periodic, triggered by other physical phenomena (motion sensors in an area)). The signal received (326) by product 126 may permit registration to begin, continue, or complete successfully.

In a registered and idle state (328), product 126 may prepare for use by periodically determining whether product 126 is in a suitable zone (e.g., of the same type as the first suitable zone or a different zone). Here, marker 110 is representative of the same marker as in 324, a marker of the same type, or a different marker. Communication by sending (330) and receiving (332) signals may be analogous to communication discussed above with reference to 324 and 326. Sending (330) by product 126 may be in response to a user indicating an intent to use a product function conditioned on registration (e.g., operating the safety switch of weapon 126). Receiving 332 may be prerequisite to entering (334) the active state.

In the active state (334), product 126 may perform one of the functions permitted suitably by prior registration (328) and/or by determining that product 126 is in the zone (332). Product 126 sends a signal (336) overtly or as a side effect of performing the permitted function. Listener 112 receives (336) the signal and performs (340) a usage reporting process (338) (e.g., activates an alarm, sends a page, sends an email, places a telephone call, posts an entry to a log, accounts for the usage, initiates a suitable follow-up action to avoid or mitigate injury to persons or damage to property).

If at any time after registration (328), product 126 determines (342) that it is not in the zone (e.g., too far separated from marker 110 to receive a signal sent by marker 110), product 126 exits the registered state and enters an unregistered state (344).

The state changes between registered and unregistered states may be implemented in a state machine as discussed above according to state transitions 360 of FIG. 3C. State transitions 360 include unregistered state 362 and registered state 363. Registered state 363 includes idle state 364 and active state 366. Product 126 may implement a unique registered state and a unique unregistered state for any zone, for any function, and for any function-zone combination. Consequently, a function of product 126 may be registered and permitted (herein called a permitted function) in a first zone; and, independently, not yet registered for use in a second zone. Also, expiration of registration for a first function and/or first zone may be independent of expiration of registration for a second function and/or second zone different from the first function and first zone.

When product 126 is successfully registered as to any function and/or zone, a transition is made from unregistered state 362 to registered state 363, preferably to idle state 364. From idle state 364, a transition may be made to active state 366 when the user expresses an intent to use the permitted function and the product is in the zone, for example by operating a control of a user interface of product 126. After zero or more uses of the permitted function in the zone, a transition from active state 366 back to idle state 364 may proceed after the user expresses no intent to use the permitted function and product 126 has not been determined to be outside the zone. However, when product 126 is determined to be not in the zone, a transition from active state 366 to unregistered state 362 for the permitted function-zone combination proceeds as a consequence.

When in idle state 364, a transition back to unregistered state 362 may be made as a consequence of any of the following: registration expired (as discussed above), tampering detected by a circuit or software of product 126 (e.g., the enclosure of product 126 is opened, a power supply portion of product 126 is decoupled from another portion of product 126, circuitry of product 126 is reset), the user expresses an intent to use a permitted function when product 126 is determined to not be in the zone.

In another implementation, one or more of the transitions back into unregistered state 362 may instead transition into a second unregistered state (not shown). Exit from the second unregistered state back to the registered state 363 may be made with a second registration method different from the first registration method that was performed to enter for the first time the registration state 363. By using a second registration method, simpler and less burdensome re-entry of registered state 363 may be accomplished (e.g., simply entering a code at a user interface of product 126). The risk of untrustworthy communication may be minimal due to other procedural controls (e.g., weapons check-in and check-out procedures minimize the possibility of mistaking the identity of the applicant 122 and the identity of the weapon 126).

Product 126 may include a weapon. For example, weapon 400 of FIG. 4 includes receiver 402, processor 404, user interface 408, and weapon subsystem 406. Conventional circuits may be used to implement product 126 modified and supplemented as taught herein.

Receiver 402 receives (266, 276) information from a network appliance. Reception may be by connection to the network appliance (e.g., a USB cable), via a user interface (e.g., light, sound), and/or via a link (e.g., wireless network, radio). Receiver 402 includes one or more suitable detectors and circuitry for reliable reception of the information. Received information is provided to processor 404.

Processor 404 may include any conventional implementation of one or more state machines as discussed above with reference to state transitions 300 and 360. Processor 404 may in addition include processes, memory, and input/output functions and structures implemented in any combination of hardware, firmware, and/or software. Processor 404 performs processes 208, 211, 215, 216, and 217, discussed above. In addition, processor 404 may perform suitable communication processes (not shown) in support of communication via receiver 402 (e.g., decoding, unformatting, error detecting). Further, processor 404 may include circuits and perform all suitable processes in support of weapon subsystem 406 (e.g., timing, control, obtaining status).

User interface 408 may include switches and indicators for control and status of conventional weapon functions (e.g., safety, trigger, reapplication of electrical stimulus, range priority selection). According to various aspects of the present invention, one or more status indicators, a display, speaker, link, or other output device of weapon 400 may be used to communicate (268, 278) with applicant 122 or network appliance 124. In one implementation, receiver 402 is omitted and an input device (e.g., microphone, camera) of user interface 408 is used to receive information (266, 276) from network appliance 124. User interface 408 cooperates with processor 404 to provide indicia of user set up and operation of weapon 400 to processor 404; and to indicate, display, or transmit data (e.g., status, messages, signals) from processor 404 to the user of weapon 400 or to network appliance 124.

Operation of a safety switch may indicate to weapon 400 an intent of the user to use a permitted function as discussed above. When the safety switch is moved from the safety on to the safety off position, one or more registrations may expire if weapon 400 is not in the zone matching those one or more registrations. When a registration expires, a display or speaker may provide notice to the user. When a registration expires, notice may accomplished by sending a signal as discussed above. For example, a registration expiration message may be transmitted by radio to a listener and/or a central location (e.g., a dispatcher, emergency response center, hospital, or other weaponry including an area denial system related to the zone in which the product is located when expiration occurred). The message may include a description of the applicant 122, a description of the weapon 126, a description of the zone, and/or expiration date and time.

Weapon subsystem 406 includes any conventional weaponry apparatus (e.g., a mechanism or circuit) for implementing all conventional operations of a lethal or nonlethal firearm, mine, projectile, area denial system, and/or electronic control device. For example, for an implementation of weapon 400 as an electronic control device, weapon subsystem 406 may include magazine, cartridge, or projectile circuitry of the conventional type that produces a current through skeletal muscles of a human or animal target to halt locomotion by the target. Such an electronic control device may implement a local stun function where weapon 400 is held against or proximate to tissue of the target so that the current can arc to pass through the target. Such an electronic control device may implement a remote stun function where weapon 400 launches one or more wire tethered darts that conduct the current from a signal generator in weapon 400 to a remote target (e.g., about 15 feet (5 meters) from weapon 400). The portion of weapon subsystem 406 that communicates with processor 404 may perform the functions of a magazine, cartridge, projectile, and/or launch device (e.g., for electronic projectiles or wire tethered darts)). In addition, weapon subsystem may include peripheral input and output devices related to weaponry including, for example, a video camera (aimed toward the target), a cellular phone link, a global positioning system (GPS) receiver, a user identification apparatus (e.g., biometric sensor), a sound recorder, and/or a sound emitter or speaker for alarms or synthesized voice.

A processor for a weapon may perform the functions discussed above with reference to product 126 and perform none, some, or all of the functions discussed above with reference to weapon processor 404 and the processing functions of weapon subsystem 406. For example, processor 404 of FIG. 5 serves as the primary (or central) processor for an electronic weapon implementation of product 126. Processor 404 of FIG. 5 includes signal conditioner function 502, logic circuit 504, memory 506, and signal generator function 508.

Signal conditioner function 502 may include electrical bias and/or detectors for manually operated controls of user interface 408 and detection circuitry for status of weapon subsystem 406. Conventional circuits and techniques may be used.

Logic circuit 504 may include a microcontroller, microprocessor, or state machine programmed or implemented to perform processing functions particular to a weapon. Logic circuit receives input signals from signal conditioner 502. Logic circuit receives data, state, and operating instructions from memory 506; and stores data, new states and program control information in memory 506. Logic circuit 504 outputs control signals to signal generator 508. Logic circuit 502 may include hardware and/or software for maintaining time of day, date, and for measuring durations governing state changes and weapon functions.

Memory 506 may include any conventional nonvolatile or volatile storage including magnetic, optical, and semiconductor storage technologies. A portion of memory 506 may be removable to facilitate, for example, upgrading processing by processor 404, or transfer of information from weapon 400 to other systems. Memory 506 may store instructions and data (e.g., descriptions, states) for any of the functions and/or communications discussed above.

A signal generator may use conventional technologies to generate signals used within weapon 400 and transmitted out of weapon 400. For an electronic control device, signal generator 508 suitably includes a high voltage power supply for generating a signal sufficient to ionize air and form one or more arcs to complete a circuit through the target. Signal generator 508 may also generate the current used to halt locomotion by the target for local and/or remote stun functions as discussed above.

Weapon 400 in operation includes an unregistered state and a registered state as discussed above. Use in the registered state may be continuous, as needed, occasional, or intermittent without necessarily bringing about a reversion to the unregistered state. One, some, or all of the functions of signal generator 508 may be disabled while weapon 400 is in an unregistered state. To enable one, some, or all disabled functions, qualified registration as discussed above may be repeated. Qualified registration by one applicant may enable a first group of functions (e.g., a local stun function, limited range function with particular cartridge types). Qualified registration by another applicant may enable a second different group of functions in the same or a different weapon.

Registration may expire. To assure that the user has sufficient notice of pending or current expiration, the product may include an indicator (e.g., "ready"/"not ready"; or "service needed") and a control, operation of which reinstates the unregistered state. For example, opening an enclosure of the product, performing periodic maintenance (e.g. replacing batteries), or effecting configuration changes, upgrades, troubleshooting or repair may actuate the control to cause expiration and consequently require re-registration.

Expiration and re-registration of applicants using qualified registration as discussed above may facilitate management of user training, both initial user education and continuing education, for users of products. For example, a basic weapon function may require completion of basic training. Satisfactory completion of training may be logged in a database maintained by registration server 102 or qualification server 104. If maintained by registration server 102, registrar process 204 may perform a portion of the qualifier process as to training criteria, qualifications, questions, and answers. Instead, training records may be provided (236) to qualification server 104 (e.g., added to group one answers to provide group two answers) for qualifier process 206 to analyze and integrate with other criteria, qualifications, questions, summaries, weights, ranks, and/or scores. A registered user's training records may be stored by (e.g., in) product 126 (216) with group five information as discussed above. A processor of product 126 (e.g., processor 404 or weapon 400) may supply training status to a user interface (e.g., 408, or 124) to inform a user of what functions of the product are enabled, when registration expires, what functions are available with additional registration, and/or how to apply for additional registrations (e.g., a URL suitable for each registration).

A product may comprise portions facilitating upgrades to implement the structures and functions discussed above. For example, weapon 600 of FIG. 6 includes a non-user-accessible portion 606 and a user-accessible portion 602. Weapon 600 may further include or accept replaceable cartridges, rounds, and/or magazines (not shown) for exerting a force at a distance (e.g., containing propellant, wire-tethered darts, electrified projectiles, nets) or other peripherals for local stun functions (e.g., terminals, restraints, patches, bands, manacles, shackles). The term 'user-accessible' indicates a design goal that permits and encourages the unskilled ordinary user without special tools to easily purchase, install, and/or replace the user-accessible portion of the product. For a product, the user-accessible portion may be no more difficult to replace than downloading software from the Internet or replacing a battery pack. For a weapon, the user-accessible portion may be no more difficult to replace than replacing a consumable portion such as a magazine, cartridge, round, or electrified projectile.

Non-user-accessible portion 606 includes user interface 408, processor 404, having memory 506, and weapon subsystem 406 as discussed above. Non-user-accessible portion 606 may have a receiver for cartridges, rounds, and/or magazines. Non-user-accessible portion 606 may include a receiver (not shown) for accepting, supporting, and/or enclosing the housing 604 of user-accessible portion 602. Weapon 600 may be functional without a user-accessible portion installed, for example in an implementation (not shown) where non-user-accessible portion 606 further includes a source of operative power.

User-accessible portion 604 may include one or more of the following: battery 612, switch 614, zone tester 616, receiver 402, and/or usage advisor 618. User-accessible portion 602 may have a housing (e.g., enclosure, partial enclosure) that supports those components with size and shape to fit in whole or in substantial part inside or against housing 601 of weapon 600.

A battery provides operative power to weapon 600. A signal conveyed on current supplied by the battery may be used to initiate a state transition from registered to unregistered as discussed above. For example, interrupting current from battery 612 may signal a soft or hard reset to processor 404 to accomplish initialization including restarting from a predefined state of being unregistered as to one or more functions and as to one or more zones. The interruption may be brief or continue until weapon 600 is serviced.

A switch receives current from a battery and conditionally provides current to non-user-accessible portion 606. For example, switch 614, controlled by zone tester 616 conducts current from battery 612 to non-user-accessible portion 606 until zone tester 616 indicates that the current is to be interrupted to indicate the weapon is no longer in a zone.

A zone tester determines whether a condition related to a zone as discussed above is satisfied (e.g., the zone tester is in a zone). When a zone tester is mechanically coupled to a weapon (e.g., installed in a suitable receiver of the weapon), the location of the zone tester implies the location of the weapon. Because a zone may be defined by several different types of signals, zone tester 616 includes any suitable mechanical and/or electrical components to accomplish determining whether the condition as to a particular zone is satisfied. As a first example, when a zone is defined by proximity to a simple marker such as a passive object (e.g., a reflector, RFID device, magnetic fob, smartcard, mechanical key), zone tester 616 may include a mechanical receiver for the object for retaining the object and actuating switch 614, a conventional proximity sensor, and/or suitable output circuitry to electrically control switch 614. As another example, when a zone is defined by radio signals and/or messages communicated with one or more markers 110, zone tester 616 includes a receiver, a transponder, and/or a transmitter and may further include logic circuitry for processing such signals and/or messages. Zone tester 616 may communicate with processor 404 directly; and, switch 614 may be omitted.

A receiver receives signals and provides information conveyed by the received signals to processor 404 in any conventional manner. Electric, magnetic, optical, acoustic, and/or radio signals may be received. Receiver 402 communicates with a network appliance 124 as discussed above. Receiver 402 may communicate with one or more markers 110 and may perform the functions of zone tester 616 for zones defined by radio signals. Multiple conditions related to one or more zones may be implemented with a weapon that includes one or more zone testers 116 and/or one or more receivers 402.

Receiver 402 may be replaced with a transmitter, transponder, or transceiver for communicating with various network appliances 124, markers 110, and/or listeners 112. One or more zone testers 116 and/or one or more usage advisors 618 may be omitted as such a transmitter, transponder, or transceiver performs the functions described herein for those functional blocks.

A usage advisor communicates use of a function to a listener. When use of the function may be detected directly from weapon subsystem 406 by a suitably equipped listener 112, usage advisor 618 may be omitted. In other implementations, advice of a use is accompanied by additional information not made known by simply operating weapon subsystem 406. For example, usage advisor may communicate via a short range link to a listener worn by the user of weapon 600; or usage advisor may communicate via infrared or radio to an access point of a security system, as discussed above. For example, usage advisor 618 provides the message sending capability to advise a listener (or a security system with built in monitor of wireless communication from sensors) of one or more of the following: a description of the user, a description of the weapon, a description of the location of the weapon (e.g., GPS coordinates within a relatively large zone), a description of the function performed, and date and time of performance of the function. When advisor 618 communicates with a security system, advisor 618 may send a signal in any conventional manner (e.g., as if advisor 618 was a conventional sensor with a wireless communication capability to a security system).

There are many possible designs for a user-accessible portion each including combinations of the various functions discussed above. A family of several user-accessible portions having different complements of functions may be designed to have size and shape suitable for being interchangeable in a receiver of weapon 600. Consequently, replacing a user-accessible portion with another user-accessible portion having different capabilities may accomplish an upgrade of weapon 600.

A zone tester and marker may use magnetic proximity. For example, combination zone tester and marker 700 may cooperate with weapon 600 as zone tester 616 and marker 110 discussed above. Such a combination includes lanyard 702, magnet 704, and retainer 706 that cooperate with switch 614 (e.g., a reed switch operative when proximate to sufficient magnetic flux), and battery 612.

A lanyard mechanically couples a marker to a reference structure. For example, lanyard 702 mechanically couples magnet 704, a type of marker that provides a signal comprising magnetic flux, to any suitable structure. Lanyard 702 may connect magnet 704 to a police call box so that a weapon removed from the box can be used against an aggressor, but when the lanyard is pulled from the weapon (e.g., the weapon is taken from the user or taken far from the call box), the weapon becomes inoperative. Lanyard 702 may connect magnet 704 to a security guard. Weapon 600 may be used by the guard against an aggressor, but when the lanyard is pulled from the weapon (e.g., the weapon is taken from the guard), weapon 600 becomes inoperative.

A retainer may perform the zone test function as discussed above by mechanically coupling a marker within a suitable distance of a switch so that removal of the marker from the retainer moves the marker beyond a limit of proximity and consequently opens the switch. For example, retainer 706 grips opposing edges of magnet 704 to hold it against a base of retainer 706. The base is suitably thin to permit sufficient flux from magnet 704 to close reed switch 614. Grips 706 easily yield to tension from lanyard 702 to release magnet 704. When magnet 704 is released, the distance from magnet 704 to reed switch 614 may easily exceed a limit distance (e.g., one inch (2 cm)). Consequently, a loss of magnetic flux permits reed switch 614 to open.

A reed switch closes in response to magnetic flux; and, in the absence of sufficient flux, opens. When closed, switch 614 conducts current from battery 612 to non-user-accessible portion 606.

Magnet 704 defines a magnetic field around itself with flux density decreasing with distance from magnet 704. For example, up to a distances of about one inch (2 cm), magnetic flux is sufficient to reliably close reed switch 614. Consequently, reed switch 614 (a part of user-accessible portion 602 and consequently a part of weapon 600) determines whether weapon 600 is within a zone defined by a signal consisting of magnetic flux.

A listener may include one or more receivers and one or more detectors to detect whether an electronic control device has been operated for a local stun or remote stun function. A conventional ECD weapon may produce a broad spectrum signal as a result of forming relatively high voltage arcs across gaps in the ECD weapon, or between probes and a human or animal target's tissue. For example, pulse rate may be from 5 to 40 pulses per second. Each pulse may having a pulse width (e.g., measured at 50% peak amplitude into a standard load) of from 2 to 200 microseconds. The duration of a series of such pulses may extend for a period of from 2 to 60 seconds. For example, listener 112 of FIG. 8 includes multi-channel receiver 812 coupled to a plurality of antennas 810, time domain ECD properties detector 814, frequency domain ECD properties detector 816 and or-gate 818. Listener 112 outputs a signal that conveys one bit of information (true/false) as to whether an ECD is being detected. Listener 112 may further include a transducer (not shown) (e.g., an IR or low power radio transmitter or RFID transducer) so that the output of gate 818 initiates a communication (e.g., sends a signal) of the type used between a conventional panic button assembly and a conventional home intrusion alarm system to activate the alarm system as if a panic button had been actuated by a resident.

A receiver for a radio channel provides information conveyed over the channel. For example, receiver 812 receives from antennas 810 a plurality of channels and may filter, detect, demodulate, and again filter, to provide a signal for each channel that conveys the pulse width, pulse repetition rate, and pulse series duration information received from each respective channel. Receiver 812 may provide indicia of energy in each channel received.

A time domain ECD properties detector may measure one or more properties of a signal from a receiver and compare the measured values to information stored in detector 814. Such information may include ranges indicative of a variety of ECDs performing local stun and/or remote stun functions. Conventional pulse measurement circuitry (e.g., digital signal processor, logic circuitry) and/or software may be used. For example, time domain ECD properties detector 814 includes a programmed digital signal processor for measuring one or more of the ECD pulse properties discussed above and outputs a signal that an ECD local or remote stun function is being detected.

A frequency domain ECD properties detector responds to energy in each of several channels and if the energy in at least two disparate channels is sufficiently similar, broadcasting by a broad spectrum source may be inferred. For example, receiver 812 may receive and indicate energy in a channel related to a range of pulse widths discussed above (e.g., about 5 KHz to 500 KHz) and in a channel related to the pulse repetition rate (e.g., about 5 Hz to 40 Hz). Frequency domain ECD properties detector 816 may compare the energy in each channel and if both channels indicate more than a suitable threshold of energy received, output a signal that an ECD local or remote stun function is being detected.

Or-gate 818 combines the output signals of detectors 814 and 816 according to a logical or operation and outputs a logic signal indicating an ECD is being detected as discussed above.

When only a limited number of types of ECD weapons are to be detected and these types have similar ECD properties, one of detectors 814 and 816 may be omitted with commensurate simplifications of remaining functions.

A user-accessible portion of a product may include a housing and a connector sized and shaped to be installed in a receiver of the product. For example, user-accessible portion 900 (an electronics assembly) includes a housing 901 suitable for installing user-accessible portion 900 into a receiver of product 126. Any conventional electronics assembly packaging technology may be used. Portion 900 includes transceiver 904, antenna 906, serial memory 908, zone tester 910, and batter 912. These components correspond in one implementation to similarly named components of weapon 600. In portion 900, serial memory provides software to upload into product 900 for performing functions discussed above with reference to a zone tester and with reference to communication with one or more markers, and/or one or more network appliances. Connector 902 may conduct operative power to product 126 (VB, GND) and convey one bit signal (true/false) (ZONE OK) from zone tester 910 as to whether portion 900 (impliedly product 126) is in a zone. Product 126 may read signal ZONE OK as a maskable interrupt, a non-maskable interrupt, a reset, or a universal data input port signal. Consequently, battery power is not interrupted when an out of zone condition is detected. This arrangement allows for continued operation in a registered state for other functions and/or zones in the event that one function and/or zone is unregistered.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A system that detects that an electronic control device has been used, the electronic control device for inhibiting use of skeletal muscles by a human or animal target, the system comprising:

a receiver that receives a radio signal; and a circuit that detects a plurality of properties of the radio signal, compares the plurality of properties to indicia of expected properties, and outputs a signal when the plurality of properties compare successfully to the expected properties; wherein the indicia of expected properties is in accordance with use of the electronic control device that generates the radio signal concurrent with at least attempted inhibiting of use of skeletal muscles by the target.

2. The system of claim 1 wherein the indicia of expected properties comprise in the time domain and in combination a pulse repetition rate of from 5 to 40 pulses per second and a pulse series duration of from 2 seconds to 60 seconds.

3. The system of claim 1 wherein the indicia of expected properties comprise in the time domain and in combination a pulse repetition rate of from 5 to 40 pulses per second and a pulse width of from 2 to 200 microseconds.

4. The system of claim 1 wherein the indicia of expected properties comprise in the time domain and in combination a pulse repetition rate of from 5 to 40 pulses per second received on a plurality of channels, each channel having a respective different center frequency.

5. The system of claim 1 wherein the indicia of expected properties comprise in the frequency domain energy amplitudes consistent with a series of pulses having a pulse repetition rate of from 5 to 40 pulses per second and for each pulse a pulse width of from 2 microseconds to 200 microseconds.

6. The system of claim 1 wherein the indicia of expected properties comprise in the frequency domain energy consistent with repeated arcs ionization of air at a repetition rate of from 5 to 40 arcs ionizations per second.

7. The system of claim 1 further comprising:

a plurality of sensors for facility monitoring; and a processor coupled to the sensors and coupled to the circuit, the processor capable of providing a report in accordance with the signal.

8. The system of claim 1 wherein the receiver comprises a multi-channel receiver coupled to a plurality of antennas.

9. The system of claim 8 wherein the receiver provides indicia of an energy received in each channel.

10. The system of claim 1 further comprising a transducer; wherein responsive to the signal, the transducer initiates a communication.

11. The system of claim 1 wherein the circuit for detecting comprises a programmed signal processor for detecting a pulse from the electronic control device.

12. A system that detects an operation of an electronic control device, the operation of the electronic control device for attempting to provide a current through skeletal muscles of a human or animal target to inhibit locomotion of the target, the system comprising:

a receiver that receives a radio signal; and a circuit that detects a plurality of properties of the radio signal, compares the plurality of properties to indicia of expected properties, and outputs a signal when the plurality of properties compare successfully to the expected properties; wherein the indicia of expected properties is in accordance with ionization of air by the current generated by the electronic control device concurrent with the operation of the electronic control device.

13. The system of claim 12 wherein the indicia of expected properties comprise in the frequency domain energy consistent with repeated ionization of air at a repetition rate of from 5 to 40 ionizations per second.

14. The system of claim 12 wherein the indicia of expected properties in the time domain comprise a repetition rate of from 5 to 40 ionizations per second during an ionization series duration of from 2 seconds to 60 seconds.

15. The system of claim 12 wherein:

the electronic control devices provides the current as a series of current pulses that ionize air;

the series of current pulses having a pulse repetition rate of from 5 to 40 pulses per second; and each pulse of the series of current pulses having a pulse width of from 2 to 200 microseconds.

16. The system of claim 12 wherein the receiver comprises a multi-channel receiver coupled to a plurality of antennas.

17. The system of claim 16 wherein the receiver provides indicia of an energy received in each channel.

18. The system of claim 12 further comprising a transducer, wherein responsive to the radio signal, the transducer initiates a communication.

19. The system of claim 12 wherein the circuit for detecting comprises a programmed signal processor for detecting a pulse from the electronic control device.

* * * * *